US005416494A

United States Patent [19]

Yokota et al.

[11] Patent Number: 5,416,494

[45] Date of Patent: May 16, 1995

[54] ELECTROLUMINESCENT DISPLAY

[75] Inventors: Minoru Yokota, Nagoya; Masahiko Osada, Hekinan; Muneaki Matsumoto, Okazaki, all of Japan

[73] Assignee: Nippondenso Co., Ltd., Aichi, Japan

[21] Appl. No.: 997,310

[22] Filed: Dec. 23, 1992

[30] Foreign Application Priority Data

| | | | |
|---|---|---|---|
| Dec. 24, 1991 | [JP] | Japan | 3-341227 |
| Mar. 6, 1992 | [JP] | Japan | 4-049862 |
| Jun. 26, 1992 | [JP] | Japan | 4-169500 |

[51] Int. Cl.[6] ..... G09G 3/28

[52] U.S. Cl. ..... 345/79; 345/4; 345/45; 345/209; 313/506

[58] Field of Search ..... 340/701, 805, 704; 313/500–509; 345/76–81, 4, 209; 315/169.3

[56] References Cited

U.S. PATENT DOCUMENTS

| | | | |
|---|---|---|---|
| 3,556,391 | 2/1971 | Lully | 340/781 |
| 3,621,332 | 11/1971 | Jun | 340/781 |
| 4,099,091 | 7/1978 | Yamazoe et al. | 313/509 |
| 4,253,097 | 2/1981 | Hochstrate | 340/781 |
| 4,506,193 | 3/1985 | Hope et al. | 345/45 |
| 4,568,928 | 2/1986 | Biferno | 340/781 |
| 4,689,522 | 8/1987 | Robertson | 313/506 |
| 4,728,172 | 3/1988 | Cannella | 340/781 |
| 4,733,228 | 3/1988 | Flegal | 340/781 |
| 4,777,402 | 10/1988 | Mitsumori | 340/781 |
| 4,982,183 | 1/1991 | Flegal et al. | 345/79 |
| 5,053,679 | 10/1991 | Thioulouse | 315/169.3 |

FOREIGN PATENT DOCUMENTS

| | | |
|---|---|---|
| 59-36294 | 2/1984 | Japan . |
| 63-51093 | 3/1988 | Japan . |
| 63-61285 | 3/1988 | Japan . |
| 63-30745 | 6/1988 | Japan . |
| 63-249895 | 10/1988 | Japan . |
| 3250580 | 11/1991 | Japan . |

*Primary Examiner*—Alvin E. Oberley
*Assistant Examiner*—Steven J. Saras
*Attorney, Agent, or Firm*—Cushman, Darby & Cushman

[57] ABSTRACT

An EL display includes first and second EL elements each having an EL photoemissive layer and a pair of electrodes provided on opposite surfaces of the EL photoemissive layer. The EL photoemissive layer of each of the first and second EL elements is enabled to emit light when a voltage applied between the electrodes of the EL element is equal to or greater than a given threshold value. A voltage feed circuit serves to apply a first ac voltage between the electrodes of the first EL element. The first ac voltage has a value being equal to or greater than the threshold value. The voltage feed circuit also serves to apply a second ac voltage between the electrodes of the second EL element in cases where photoemission of the second EL element is required. The second ac voltage has a value equal to or greater than the threshold value. The second ac voltage has a phase different from a phase of the first ac voltage. Furthermore, the voltage feed circuit serves to apply a third ac voltage between the electrodes of the second EL element in cases where photoemission of the second EL element is not required. The third ac voltage has a value smaller than the threshold value. The third ac voltage has a phase different from the phase of the first ac voltage.

18 Claims, 26 Drawing Sheets

(a) ELECTRIC FIELD (b) SOUND PRESSURE (c) ELECTRIC FIELD (d) SOUND PRESSURE (f) SOUND PRESSURE

FIG. 28

| | UPPER ELEMENT PHOTOEMISSION ON | UPPER ELEMENT PHOTOEMISSION OFF |
|---|---|---|
| LOWER ELEMENT PHOTOEMISSION ON | □ ① <br> ⊡ ② | ▧ ③ <br> ⊡ ② |
| LOWER ELEMENT PHOTOEMISSION OFF | □ ① <br> ▨ ④ | ▥ ⑤ <br> ▥ ⑤ |

ELECTROLUMINESCENT DISPLAY

BACKGROUND OF THE INVENTION

1. Field of the Invention

This invention relates to an electroluminescent (EL) display of an ac driven type.

2. Description of the Prior Art

EL displays of an ac driven type have an EL photoemissive layer, and a pair of electrodes formed on opposite surfaces of the EL photoemissive layer. When an ac voltage of a given amplitude or greater is applied between the electrodes, the EL photoemissive layer is excited to emit light so that display information can be indicated.

EL photoemissive layers are made of, for example, ZnS. The EL photoemissive layer made of ZnS exhibits the piezoelectric effect. Thus, in the EL display, when an ac voltage is applied between the electrodes, the EL photoemissive layer vibrates due to the piezoelectric effect so that noise tends to occur.

Various techniques have been developed to suppress or prevent such noise in an EL display. For example, Japanese published unexamined patent application 63-61285 and Japanese published examined patent application 63-30745 disclose that a spacer is provided between a display frame and an EL photoemissive layer, and the display frame and the EL photoemissive layer are sealed to prevent a leakage of noise from the EL photoemissive layer. EL displays disclosed by Japanese published unexamined patent application 63-61285 and Japanese published examined patent application 63-30745 tend to be large in size due to the presence of the spacer.

Japanese published unexamined patent application 63-249895 discloses that rising and falling edges in an applied ac voltage are made into gentle slopes to suppress or prevent noise generated by an EL photoemissive layer. The noise suppression technique disclosed by Japanese published unexamined patent application 63-249895 is ineffective to noise of a frequency equal to a frequency of the applied ac voltage.

Japanese published unexamined patent application 3-250580 discloses a method of driving EL elements. According to the method of Japanese application 3-250580, ac drive voltages having equal values and opposite polarities are applied to adjacent EL elements respectively to reduce electric-field induced noise.

SUMMARY OF THE INVENTION

It is an object of this invention to provide an improved EL display.

A first aspect of this invention provides an EL display comprising a first EL element and a second EL element. The EL elements may include a pair of electrodes and an EL photoemissive layer disposed between the electrodes. The EL photoemissive layer is capable of emitting light when a voltage applied between the electrodes is equal to or greater than a threshold value. The EL display also includes a voltage feed means for applying a first ac voltage between the electrodes of the first EL element, and for applying a second ac voltage between the electrodes of the second EL element at the same time as the application of the first ac voltage. The first ac voltage has a value which is equal to or greater than the threshold value and the second ac voltage has a polarity which is opposite to a polarity of the first ac voltage. The second ac voltage has a value which is either equal to or greater than the threshold value when photoemission of the second EL element is required or smaller than the threshold value when photoemission of the second EL element is not required.

In another embodiment, an EL display includes a plurality of EL elements, each disposed so as to be capable of indicating either of preset characters. Each of the EL elements is capable of emitting light when a voltage having an absolute value which is equal to or greater than a threshold value is applied thereto. The EL elements include at least a first EL element and a second EL element. The EL display also includes means for feeding a first ac drive voltage to the first EL element so as to activate the first EL element and means for feeding a second ac drive voltage to the second EL element, at the same time the first ac drive voltage is fed to the first EL element, so as to activate the second EL element at the same time the first EL element is activated. The first ac drive voltage has a value which is equal to or greater than the threshold value. The second ac drive voltage has a value which is equal to or greater than the threshold value and has a polarity which is opposite to a polarity of the first ac drive voltage.

In another embodiment, an EL display includes an EL photoemissive layer which is capable of emitting light when a voltage having an absolute value equal to or greater than a threshold value is applied thereto. The EL photoemissive layer has a first surface and a second surface. The EL display may also include a plurality of scanning electrodes disposed on the first surface. The scanning electrodes are disposed so as to be parallel to each other. The EL display may also include a plurality of data electrodes disposed on the second surface. The data electrodes are disposed so as to be parallel to each other. The EL display may also include scanning-electrode voltage feed means for sequentially feeding a scanning voltage to the scanning electrodes and for sequentially feeding an anti-phase voltage to the scanning electrodes. The scanning voltage has an absolute value which is smaller than the threshold value. The anti-phase voltage has an absolute value smaller than the threshold value and has a polarity which is opposite to a polarity of the scanning voltage. The scanning voltage and the anti-phase voltage are fed, at the same time, to different scanning electrodes. Finally, the EL display may also include data-electrode voltage feed means for feeding, at the same time the scanning voltage is fed to the scanning electrodes, a data voltage to a selected one of the data electrodes. The data voltage has an absolute value which is smaller than the threshold value but is greater than the threshold value minus the scanning voltage. The data voltage has a polarity which is opposite to the polarity of the scanning voltage.

In another embodiment, an EL display includes a first EL photoemissive layer having an axis related to piezoelectricity and a second EL photoemissive layer having an axis related to piezoelectricity. The EL display may also include first means for generating an ac voltage and second means for applying a first ac electric field to the first EL photoemissive layer so as to activate the first EL photoemissive layer in response to the ac voltage generated by the first means. The EL display may also include third means for applying a second ac electric field to the second EL photoemissive layer so as to activate the second EL photoemissive layer in response to the ac voltage generated by the first means. The third means applies the second ac electric field simultaneously with the application of the first ac electric field by the second means. A direction of the first ac electric field relative to the piezoelectricity-related axis of the first EL photoemissive layer is substantially antiparallel to a direction of the second ac electric field relative to the piezoelectricity-related axis of the second EL photoemissive layer.

In another embodiment, an EL display includes a first EL photoemissive layer having an axis related to piezoelectricity and a second EL photoemissive layer having an axis related to piezoelectricity. The EL display may include first means for generating a first ac voltage having a first polarity and second means for applying a first ac electric field to the first EL photoemissive layer so as to activate the first EL photoemissive layer in response to the first ac voltage generated by the first means. The EL display may also include third means for generating a second ac voltage having a second polarity which is equal to the first polarity. The EL display may also include fourth means for applying a second ac electric field to the second EL photoemissive layer so as to activate the second EL photoemissive layer in response to the second ac voltage generated by the third means. The fourth means applies the second ac electric field simultaneously with the application of the first ac electric field by the second means. A direction of the first ac electric field relative to the piezoelectricity-related axis of the first EL photoemissive layer is substantially antiparallel to a direction of the second ac electric field relative to the piezoelectricity-related axis of the second EL photoemissive layer.

BRIEF DESCRIPTION OF THE DRAWINGS

FIG. 28 is a diagram showing driven conditions of EL elements in the fifteenth embodiment of this invention.

DESCRIPTION OF THE FIRST PREFERRED EMBODIMENTS

Figure 1:
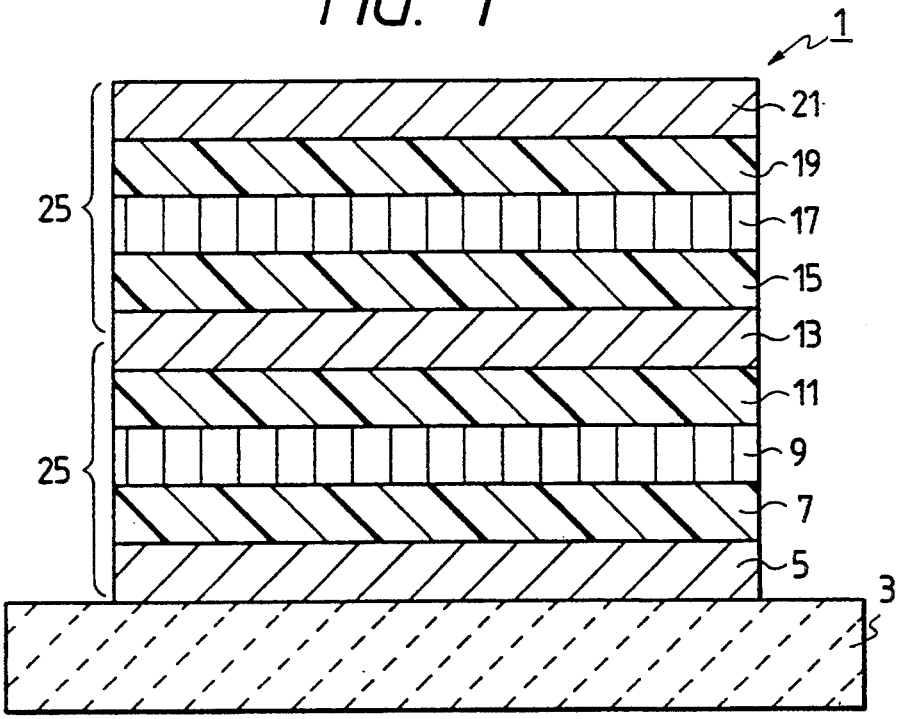
FIG. 1 is a sectional view of an EL display according to a first embodiment of this invention.

With reference to FIG. 1, an EL display 1 includes a glass substrate or a glass base plate 1, and a laminated structure formed on the glass base plate 1. The laminated structure has a first transparent electrode 5, a first insulating layer 7, a first EL photoemissive layer 9, a second insulating layer 11, a second transparent electrode 13, a third insulating layer 15, a second EL photoemissive layer 17, a fourth insulating layer 19, and a back electrode 21 which are sequentially arranged on the glass base plate 1.

The first transparent electrode 5 and the second transparent electrode 13 are made of transparent material such as ITO (Indium Tin Oxide), ZnO, or Ga-doped ZnO. The back electrode 21 is made of aluminum, ITO, or ZnO. The first EL photoemissive layer 9 and the second EL photoemissive layer 17 are made of photoemissive material such as ZnS into which Mn, TbOF, or the like is added as photoemission centers. The first insulating layer 7, the second insulating layer 11, the third insulating layer 15, and the fourth insulating layer 19 are made of insulating material such as $Ta_2O_5$, alumina, or $Si_3N_4$.

When an ac voltage of a level greater than a threshold value (a photoemission starting voltage related to the first EL photoemissive layer 9) is applied between the first transparent electrode 5 and the second transparent electrode 13, the first EL photoemissive layer 9 is excited to emit light. Similarly, when an ac voltage of a level greater than a threshold value (a photoemission starting voltage related to the second EL photoemissive layer 17) is applied between the second transparent electrode 13 and the back electrode 21, the second EL photoemissive layer 17 is excited to emit light. The first transparent electrode 5, the first insulating layer 7, the first EL photoemissive layer 9, the second insulating layer 11, and the second transparent electrode 13 compose a first EL element or a first EL display section 23. The second transparent electrode 13, the third insulating layer 15, the second EL photoemissive layer 17, the fourth insulating layer 19, and the back electrode 21 compose a second EL element or a second EL display section 25.

Figure 2:
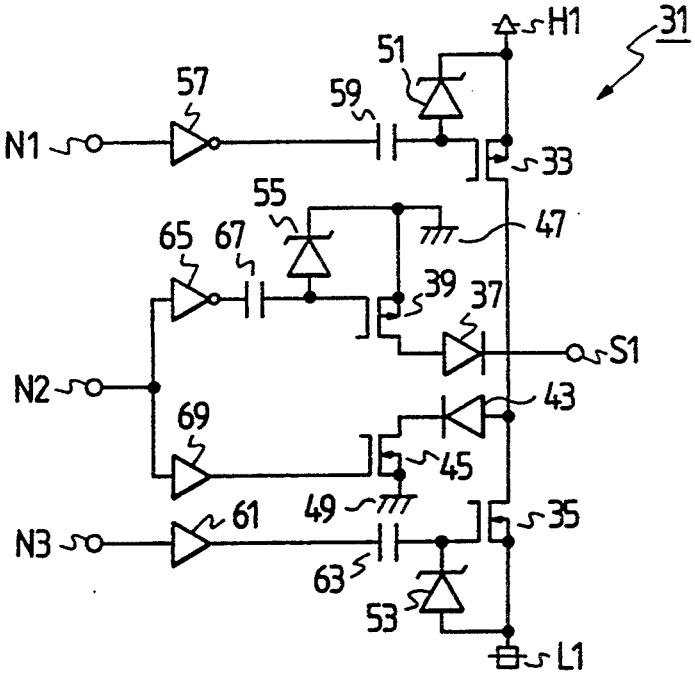
FIG. 2 is a schematic diagram of a voltage feed circuit in the first embodiment of this invention.

The first transparent electrode 5 and the back electrode 21 are subjected to an ac voltage fed from a voltage feed circuit 31 shown in FIG. 2. The second transparent electrode 13 is connected to a ground electrode (not shown), and is thus grounded via the ground electrode.

It is preferable that the axes of the first EL photoemissive layer 9 and the second EL photoemissive layer 17 which relate to polarities of piezoelectricity extend in parallel.

As shown in FIG. 2, the voltage feed circuit 31 includes three input terminals N1, N2, and N3, and an output terminal S1. The input terminals N1, N2, and N3 are connected to a C-MOS logic IC (not shown). The output terminal S1 is connected to the first transparent electrode 5 and the back electrode 21.

The output terminal S1 is connected to the drains of a field effect transistor (FET) 33 and a FET 35. The output terminal S1 is connected to the drain of a FET 39 via a diode 37, and is also connected to the drain of a FET 45 via a diode 43. The polarity of the diode 37 is designed so as to block a current from the output terminal S1 toward the FET 39. The polarity of the diode 43 is designed so as to block a current from the FET 45 toward the output terminal S1.

The source of the FET 33 is connected to an electrode H1 subjected to a given high voltage VH1 (which is higher than a ground potential equal to 0 volt). The source of the FET 35 is connected to an electrode L1 subjected to a given low voltage VL1 (which is lower than a ground potential equal to 0 volt). The source of the FET 39 is connected to a ground electrode 47, and is thus grounded via the ground electrode 47. The source of the FET 45 is connected to a ground electrode 49, and is thus grounded via the ground electrode 49. A zener diode 51 is connected between the gate and the source of the FET 33. A zener diode 53 is connected between the gate and the source of the FET 35. A zener diode 55 is connected between the gate and the source of the FET 39. When gate-source voltages of the FET's 33, 35, and 39 rise to given voltages, the zener diodes 51, 53, and 55 undergo breakdown to protect the FET's 33, 35, and 39. The FET 45 is designed so that it can be switched in response to a digital signal of a voltage variable in the range of 0 to 5 volts. Thus, such a protective zener diode is unnecessary for the FET 45.

The gate of the FET 33 is connected to the input terminal N1 via an inverter 57 and a capacitor 59. The input terminal N1 receives an output digital signal from the C-MOS logic IC. A drive voltage for the EL element 25 is induced at the output terminal S1. While the digital signal applied to the input terminal N1 has a voltage variable in the range of 0 to 5 volts, the drive voltage applied to the output terminal S1 has a voltage which sometimes rises to several hundreds of volts. The capacitor 59 blocks dc components of a current, protecting the C-MOS logic IC from such a high voltage.

The gate of the FET 35 is connected to the input terminal N3 via a driver or a buffer 61 and a capacitor 63. The gate of the FET 39 is connected to the input terminal N2 via an inverter 65 and a capacitor 67. The gate of the FET 45 is connected to the input terminal N2 via a driver or a buffer 69.

The FET's 33 and 39 are of the p-channel type, being turned on when the gate voltage thereof assumes a low level. The FET's 35 and 45 are of the n-channel type, being turned on when the gate voltage thereof assumes a high level.

Figure 3:
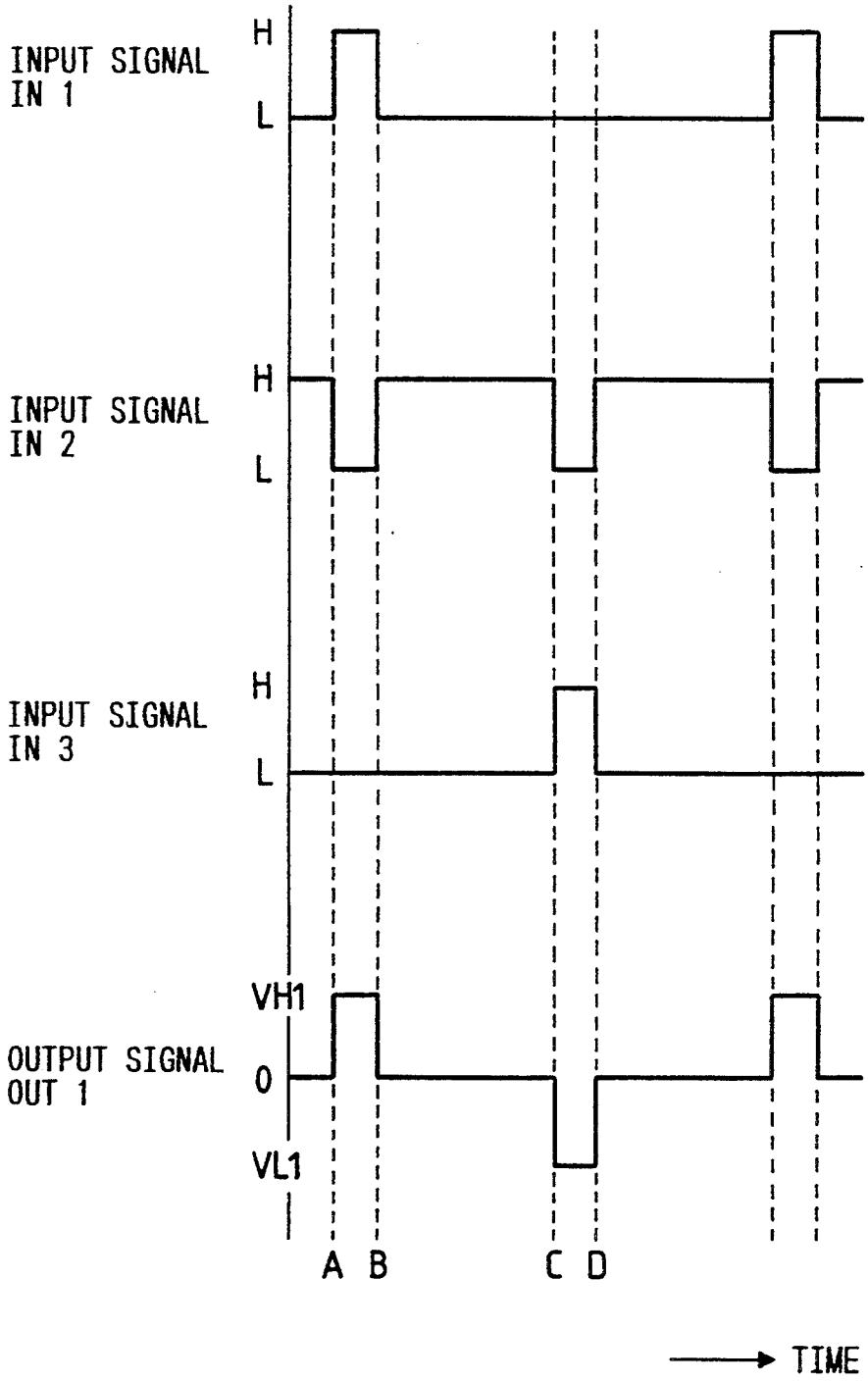
FIG. 3 is a timing chart showing the waveforms of signals inputted into and outputted from the voltage feed circuit of FIG. 2.

The voltage feed circuit 31 operates as follows. The input terminals N1, N2, and N3 receive control signals (input signals) IN1, IN2, and IN3 from the C-MOS logic IC respectively. As shown in FIG. 3, the input signals IN1, IN2, and IN3 are binary signals which can change between a high level and a low level.

During a period until a moment "A", the input signal IN2 is in the high level state, and thus the gate voltage of the FET 39 is in a low level state so that the FET 39 is on (conductive). During the same period, the gate voltage of the EFT 45 is in a high level state so that the FET 45 is on (conductive). Thus, the output terminal S1 is connected or shunted to the ground electrodes 47 and 49.

In addition, during this period, both the input signals IN1 and IN3 are in the low level states. Since the input signal IN1 is in the low level state, the gate voltage of the FET 33 is in a high level state so that the FET 33 is off (non-conductive). Since the input signal IN3 is in the low level state, the gate voltage of the FET 35 is in a low level state so that the FET 35 is off (non-conductive). Thus, the output terminal S1 is disconnected from the high voltage electrode H1 and the low voltage electrode L1, and the voltage of the drive signal outputted via the output terminal S1 is equal to 0 volt. The drive signal outputted via the output terminal S1 is referred to as an output signal OUT1. In this way, during the period until the moment "A", the output signal OUT1 remains in a 0-volt state.

At the moment "A", the input signal IN1 changes to the high level and the input signal IN2 changes to the low level while the input signal IN3 continues to be in the low level state. When the input signal IN1 changes to the high level, the FET 33 is turned on so that the output terminal S1 is connected to the high voltage electrode H1. When the input signal IN2 changes to the low level, the FET's 39 and 45 are turned off so that the output terminal S1 is disconnected from the ground electrodes 47 and 49. On the other hand, the input signal IN3 remains in the low level state so that the FET 35 continues to be off. As a result, at the moment "A", the output signal OUT1 changes from 0 volt to the high voltage VH1 applied to the high voltage electrode H1. During a subsequent period until a moment "B", the output signal OUT1 remains in the high voltage state.

At the moment "B", the input signal IN1 returns to the low level and the input signal IN2 returns to the high level while the input signal IN3 continues to be in the low level state. Thus, the output signal OUT1 also returns to the 0-volt state as during the period preceding the moment "A". During a subsequent period until a moment "C", the output signal OUT1 remains in the 0-volt state.

At the moment "C", the input signal IN3 changes to the high level and the input signal IN2 changes to the low level while the input signal IN1 continues to be in the low level state. When the input signal IN3 changes to the high level, the FET 35 is turned on so that the output terminal S1 is connected to the low voltage electrode L1. When the input signal IN2 changes to the low level, the FET's 39 and 45 are turned off so that the output terminal S1 is disconnected from the ground electrodes 47 and 49. On the other hand, the input signal IN1 remains in the low level state so that the FET 33 continues to be off. As a result, at the moment "C", the output signal OUT1 changes from 0 volt to the low voltage VL1 applied to the low voltage electrode L1. During a subsequent period until a moment "D", the output signal OUT1 remains in the low voltage state.

At the moment "D", the input signal IN3 returns to the low level and the input signal IN2 returns to the high level while the input signal IN1 continues to be in the low level state. Thus, the output signal OUT1 also returns to the 0-volt state as during the period preceding the moment "C". During a given subsequent period, the output signal OUT1 remains in the 0-volt state.

Such processes and time-domain changes in the output voltage OUT1 are periodically reiterated. Thus, the output voltage OUT1 has an ac pulse-train form.

It should be noted that the diode 37 prevents a reverse bias voltage from being applied to the FET 39 when the FET 33 is turned on. In addition, the diode 43 prevents a reverse bias voltage from being applied to the FET 45 when the FET 35 is turned on.

Figure 4:
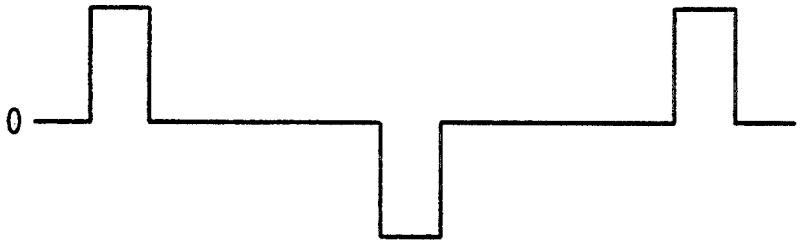
FIGS. 4*a*–4*e* is a timing chart showing time-domain variations in electric fields and sound pressures in the EL display of FIG. 1.
Figure 4:
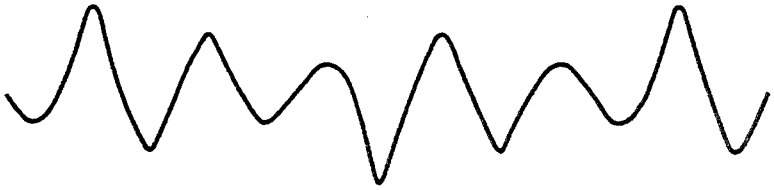
Figure 4:
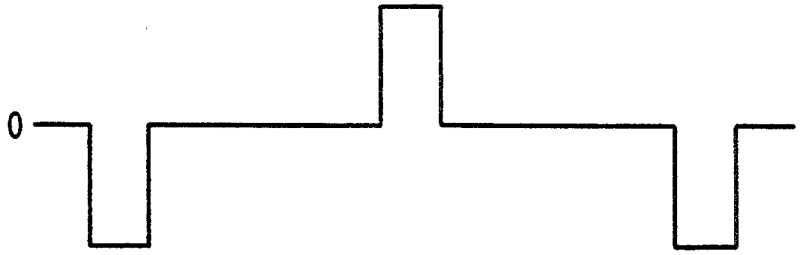
Figure 4:
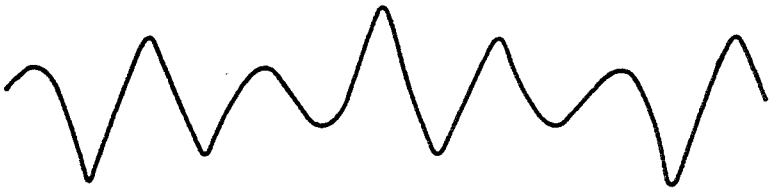
Figure 4:
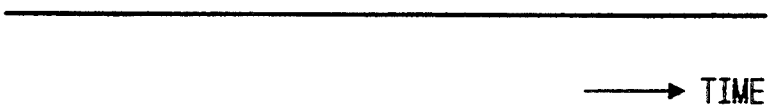

The output voltage OUT1 is applied to the first transparent electrode 5 and the back electrode 21. As previously described, the second transparent electrode 13 is grounded and remains subjected to a zero volt potential. Thus, at every moment, a direction of an electric field applied to the first EL photoemissive layer 9 is antiparallel to a direction of an electric field applied to the second EL photoemissive layer 17. Here, the directions of the electric fields applied to the first and second EL photoemissive layers 9 and 17 are defined relative to the piezoelectricity-related axes of the first and second EL photoemissive layers 9 and 17. In addition, at every moment, an intensity (an absolute value) of the electric field applied to the first EL photoemissive layer 9 is substantially equal to an intensity (an absolute value) of the electric field applied to the second EL photoemissive layer 17. In other words, the first EL photoemissive layer 9 and the second EL photoemissive layer 17 are subjected to ac electric fields having opposite polarities (i.e., being out of phase by 180 degrees) but having substantially equal amplitudes. The ac electric field applied to the first EL photoemissive layer 9 changes as shown in the part (c) of FIG. 4, while the ac electric field applied to the second EL photoemissive layer 17 changes as shown in the part (a) of FIG. 4.

Since the first EL photoemissive layer 9 and the second EL photoemissive layer 17 have the piezoelectric effect, the application of the ac electric fields to the first EL photoemissive layer 9 and the second EL photoemissive layer 17 causes vibrations thereof. The ac electric fields applied to the first EL photoemissive layer 9 and the second EL photoemissive layer 17 have opposite polarities but substantially equal amplitudes as previously described, so that sound pressures caused by the vibrations of the first EL photoemissive layer 9 and the second EL photoemissive layer 17 have opposite polarities (i.e., are out of phase by 180 degrees) but have substantially equal amplitudes. The sound pressure related to the first EL photoemissive layer 9 changes as shown in the part (d) of FIG. 4, while the sound pressure related to the second EL photoemissive layer 17 changes as shown in the part (b) of FIG. 4. 5 Thus, the sound pressures related to the first EL photoemissive layer 9 and the second EL photoemissive layer 17, or the vibrations thereof, well cancel each other so that a resultant sound pressure remains substantially nullified as shown in the part (e) of FIG. 4. Accordingly, in the EL display 1, noise is effectively suppressed.

Since the first EL photoemissive layer 9 and the second EL photoemissive layer 17 are simultaneously excited to emit light, the intensity of the emitted light is much greater than the intensity of emitted light in an EL display having a single photoemissive layer.

It is preferable that the first EL element 23 and the second EL element 25 are formed by thin films to enable compactness of the EL display 1.

While the second transparent electrode 13 is grounded and the first transparent electrode 5 and the back electrode 21 are connected to the output terminal S1 of the voltage feed circuit 31 in this embodiment, the second transparent electrode 13 may be connected to the output terminal S1 of the voltage feed circuit 31 and the first transparent electrode 5 and the back electrode 21 may be grounded.

Figure 5:
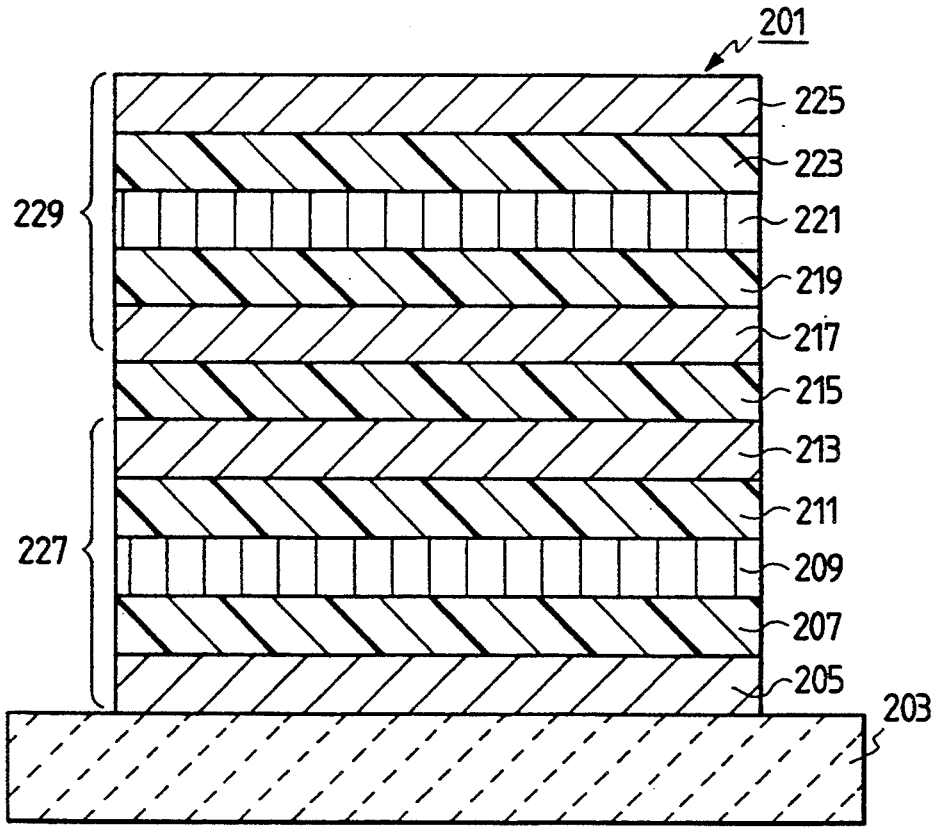
FIG. 5 is a sectional view of an EL display according to a second embodiment of this invention.

With reference to FIG. 5, an EL display 201 includes a glass substrate or a glass base plate 203, and a laminated structure formed on the glass base plate 203. The laminated structure has a first transparent electrode 205, a first insulating layer 207, a first EL photoemissive layer 209, a second insulating layer 211, a second transparent electrode 213, a third insulating layer 2 15, a third transparent electrode 217, a fourth insulating layer 2 19, a second EL photoemissive layer 221, a fifth insulating layer 223, and a back electrode 225 which are sequentially arranged on the glass base plate 203.

The first transparent electrode 205, the second transparent electrode 213, and the third transparent electrode 217 are made of transparent material such as ITO (Indium Tin Oxide), ZnO, or Ga-doped ZnO. The back electrode 225 is made of aluminum, ITO, or ZnO. The first EL photoemissive layer 209 and the second EL photoemissive layer 22 1 are made of photoemissive material such as ZnS into which Mn, TbOF, or the like is added as photoemission centers. The first insulating layer 207, the second insulating layer 211, the third insulating layer 215, the fourth insulating layer 219, and the fifth insulating layer 223 are made of insulating material such as $Ta_2O_5$, alumina, or $Si_3N_4$.

When an ac voltage of a level greater than a threshold value (a photoemission starting voltage related to the first EL photoemissive layer 209) is applied between the first transparent electrode 205 and the second transparent electrode 213, the first EL photoemissive layer 209 is excited to emit light. Similarly, when an ac voltage of a level greater than a threshold value (a photoemission starting voltage related to the second EL photoemissive layer 221) is applied between the third transparent electrode 217 and the back electrode 225, the second EL photoemissive layer 221 is excited to emit light. The first transparent electrode 205, the first insulating layer 207, the first EL photoemissive layer 209, the second insulating layer 211, and the second transparent electrode 213 compose a first EL element or a first EL display section 227. The third transparent electrode 217, the fourth insulating layer 219, the second EL photoemissive layer 22 1, the fifth insulating layer 223, and the back electrode 225 compose a second EL element or a second EL display section 229.

Figure 6:
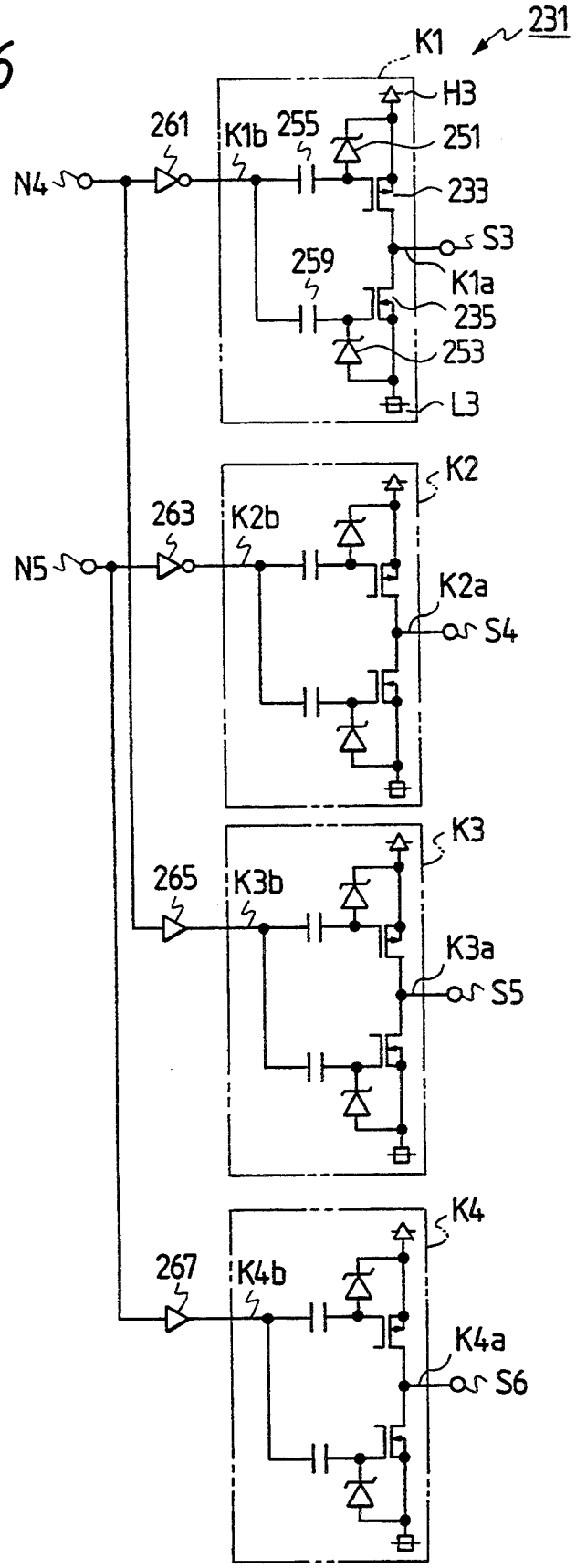
FIG. 6 is a schematic diagram of a voltage feed circuit in the second embodiment of this invention.

The first transparent electrode 205, the second transparent electrode 213, the third transparent electrode 217, and the back electrode 225 are subjected to ac voltages fed from a voltage feed circuit 231 shown in FIG. 6.

It is preferable that the axes of the first EL photoemissive layer 209 and the second EL photoemissive layer 221 which relate to polarities of piezoelectricity extend in parallel.

As shown in FIG. 6, the voltage feed circuit 23 1 includes two input terminals N4 and N5, and four output terminals S3, S4, S5, and S6. The input terminals N4 and N5 are connected to a C-MOS logic IC (not shown). The output terminal S3 is connected to the back electrode 225. The output terminal S4 is connected to the third transparent electrode 217. The output terminal S5 is connected to the second transparent electrode 2 13. The output terminal S6 is connected to the first transparent electrode 205.

The output terminal S3 is connected to the drains of a field effect transistor (FET) 233 and a FET 235. The source of the FET 233 is connected to an electrode H3 subjected to a given high voltage VH3 (which is higher than a ground potential equal to 0 volt). The source of the FET 235 is connected to an electrode L3 subjected to a given low voltage VL3 (which is lower than a ground potential equal to 0 volt). A zener diode 251 is connected between the gate and the source of the FET 233 to protect the FET 233. A zener diode 253 is connected between the gate and the source of the FET 235 to protect the FET 235.

The gate of the FET 233 is connected to one end of a capacitor 255. The gate of the FET 235 is connected to one end of a capacitor 259. The other ends of the capacitors 255 and 259 are connected to the input terminal N4 via an inverter 261.

The FET 233 is of the p-channel type, being turned on when the gate voltage thereof assumes a low level. The FET 235 is of the n-channel type, being turned on when the gate voltage thereof assumes a high level.

The circuit provided between the inverter 261 and the output terminal S3 is defined as a basic circuit K1 which has an output portion K1*a* connected to the output terminal S3 and an input portion K1*b* connected to the inverter 261.

A basic circuit K2 is similar to the basic circuit K1. The output terminal S4 is connected to an output portion K2*a* of the basic circuit K2. The input terminal N5 is connected via an inverter 263 to an input portion K2*b* of the basic circuit K2.

A basic circuit K3 is similar to the basic circuit K1. The output terminal S5 is connected to an output portion K3*a* of the basic circuit K3. The input terminal N4 is connected via a driver or a buffer 265 to an input portion K3*b* of the basic circuit K3.

A basic circuit K4 is similar to the basic circuit K1. The output terminal S6 is connected to an output portion K4*a* of the basic circuit K4. The input terminal N5 is connected via a driver or a buffer 267 to an input portion K4*b* of the basic circuit K4.

Figure 7:
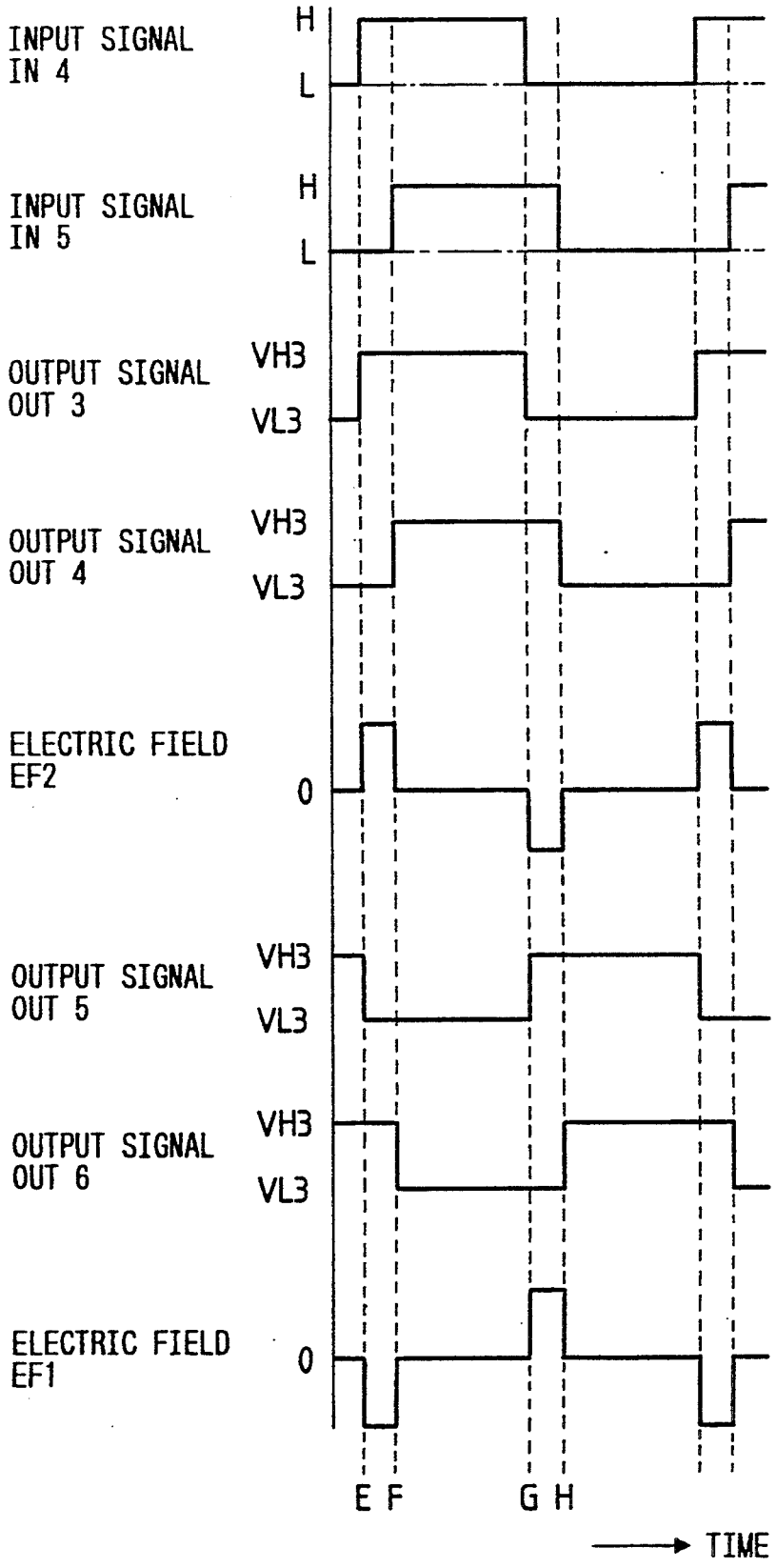
FIG. 7 is a timing chart showing the waveforms of signals inputted into and outputted from the voltage feed circuit of FIG. 6.

The voltage feed circuit 231 operates as follows. The input terminals N4 and N5 receive control signals (input signals) IN4 and IN5 from the C-MOS logic IC respectively. As shown in FIG. 7, the input signals IN4 and IN5 are binary signals which can change between a high level and a low level.

During a period until a moment "E", the input signal IN4 is in the low level state, so that the input portion K1*b* of the basic circuit K1 receives a high level signal. Thus, the gate voltages of the FET's 233 and 235 are in high level states, and the FET 233 is off (non-conductive) but the FET 235 is on (conductive). As a result, the output terminal S3 is disconnected from the high voltage electrode H3 but is connected to the low voltage electrode L3, and the voltage of the drive signal outputted via the output terminal S3 is equal to the low voltage VL3 applied to the low voltage electrode L3. The drive signal outputted via the output terminal S3 is referred to as an output signal OUT3. In this way, during the period until the moment "E", the output signal OUT3 remains in the state of the low voltage VL3.

At the moment "E", the input signal IN4 changes to the high level and the input portion K1*b* of the basic circuit K1 receives a low level signal so that the FET 233 is turned on but the FET 235 is turned off. As a result, the output terminal S3 is connected to the high voltage electrode H3 but is disconnected from the low voltage electrode L3, and the voltage of the output signal OUT3 rises to the high voltage VH3 applied to the high voltage electrode H3. During a subsequent period until a moment "G", the output signal OUT3 remains in the state of the high voltage VH3.

As understood from the previous description, the output portion K1*a* of the basic circuit K1 assumes the low voltage VL3 when the input portion K1*b* thereof receives a high level signal. On the other hand, the output portion K1*a* of the basic circuit K1 assumes the high voltage VH3 when the input portion K1*b* thereof receives a low level signal.

During a period until the moment "E", the input signal IN5 is in the low level state. The inversion of the input signal IN5 which is generated by the inverter 263 is applied to the basic circuit K2 which is connected to the output terminal S4. Thus, the voltage of the drive signal outputted via the output terminal S4 is equal to the low voltage VL3. The drive signal outputted via the output terminal S4 is referred to as an output signal OUT4. In this way, during the period until the moment "E", the output signal OUT4 remains in the state of the low voltage VL3.

The input signal IN4 is applied via the buffer 265 to the basic circuit K3 which is connected to the output terminal S5. Thus, the voltage of the drive signal outputted via the output terminal S5 is equal to the inversion of the voltage of the output signal OUT3. The drive signal outputted via the output terminal S5 is referred to as an output signal OUT5. In this way, during the period until the moment "E", the output signal OUT5 remains in the state of the high voltage VH3. At the moment "E", the output signal OUT5 changes to the low voltage VL3.

The input signal IN5 is applied via the buffer 267 to the basic circuit K4 which is connected to the output terminal S6. Thus, the voltage of the drive signal outputted via the output terminal S6 is equal to the inversion of the voltage of the output signal OUT4. The drive signal outputted via the output terminal S6 is referred to as an output signal OUT6. In this way, during the period until the moment "E", the output signal OUT6 remains in the state of the high voltage VH3.

At a moment "F" subsequent to the moment "E", the input signal IN5 changes to the high level so that the basic circuit K2 receives a low level signal and thus the output signal OUT4 changes to the high voltage VH3. At the same time, the output signal OUT6 changes to the low voltage VL3. During the period between the moment "F" and the subsequent moment "G", the input signals IN4 and IN5 remain in the high level states.

At the moment "G", the input signal IN4 returns to the low level so that the basic circuit K1 receives the high level signal and thus the output signal OUT3 returns to the low voltage VL3. At the same time, the output signal OUT5 changes to the high voltage VH3.

At a moment "H" subsequent to the moment "G", the input signal IN5 returns to the low level. Thus, the input signals IN4 and IN5 return to the states equal to the states which occur during the period until the moment "E". As a result, the output signal OUT4 returns to the low voltage VL3 while the output signal OUT6 changes to the high voltage VH3. The input signals IN4 and IN5 remain in the low level states for a given period from the moment "H".

Such processes and time-domain changes in the output voltages OUT3, OUT4, OUT5, and OUT6 are periodically reiterated. Thus, the output voltages OUT3, OUT4, OUT5, and OUT6 have ac pulse-train forms.

The output voltages OUT3, OUT4, OUT5, and OUT6 are applied to the back electrode 225, the third transparent electrode 217, the second transparent electrode 213, and the first transparent electrode 205 respectively.

The first EL photoemissive layer 209 is subjected to an ac electric field EF1 which corresponds to a difference between the output signals OUT5 and OUT6. Thus, during a period until the moment "E", the electric field EF1 remains null. At the moment "E", the electric field EF1 changes to a negative level. During the period between the moment "E"and the moment "F", the electric field EF1 remains at the negative level. At the moment "F", the electric field EF1 returns to the null state. During the period between the moment "F" and the moment "G", the electric field EF1 remains null. At the moment "G", the electric field EF1 changes to a positive level. During the period between the moment "G"and the moment "H", the electric field EF1 remains at the positive level. At the moment "H", the electric field EF1 returns to the null state. During the given period following the moment "H", the electric field EF1 remains null.

The second EL photoemissive layer 221 is subjected to an ac electric field EF2 which corresponds to a difference between the output signals OUT3 and OUT4. Thus, during a period until the moment "E", the electric field EF2 remains null. At the moment "E", the electric field EF2 changes to a positive level. During the period between the moment "E" and the moment "F", the electric field EF2 remains at the positive level. At the moment "F", the electric field EF2 returns to the null state. During the period between the moment "F" and the moment "G", the electric field EF2 remains null. At the moment "G", the electric field EF2 changes to a negative level. During the period between the moment "G" and the moment "H", the electric field EF2 remains at the negative level. At the moment "H", the electric field EF2 returns to the null state. During the given period following the moment "H", the electric field EF2 remains null.

As shown in FIG. 7, the first EL photoemissive layer 209 and the second EL photoemissive layer 221 are respectively subjected to the ac electric fields EF1 and EF2 which have opposite polarities, i.e., which are out of phase by 180 degrees, but which have substantially equal amplitudes. Thus, in the EL display 201, noise is effectively suppressed as in the embodiment of FIGS. 1–4.

Since the first EL photoemissive layer 209 and the second EL photoemissive layer 221 are simultaneously excited to emit light, the intensity of the emitted light is much greater than the intensity of emitted light in an EL display having a single photoemissive layer.

Figure 8:
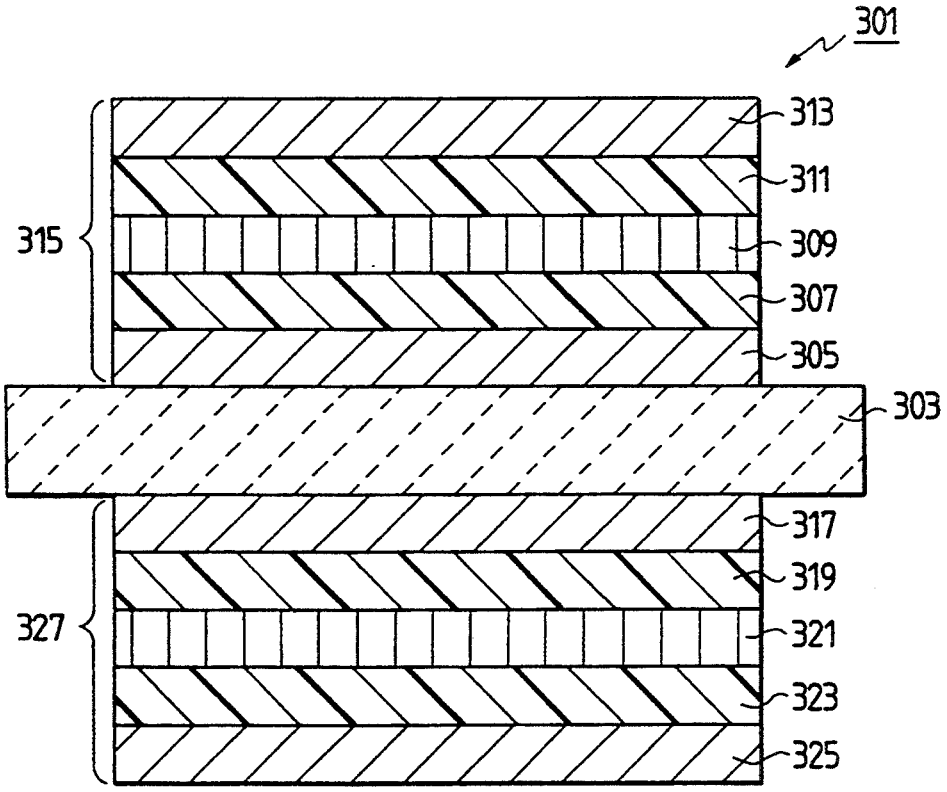
FIG. 8 is a sectional view of an EL display according to a third embodiment of this invention.

FIG. 8 shows a third embodiment of this invention which is similar to the embodiment of FIGS. 5–7 except for design changes indicated hereinafter.

With reference to FIG. 8, an EL display 301 includes a glass substrate or a glass base plate 303, and first and second laminated structures formed on opposite surfaces of the glass base plate 303 respectively. The first laminated structure has a first transparent electrode 305, a first insulating layer 307, a first EL photoemissive layer 309, a second insulating layer 311, and a back electrode 313 which are sequentially arranged on the first surface of the glass base plate 303. The members 305, 307, 309, 311, and 313 compose a first EL element or a first EL display section 315. The second laminated structure has a second transparent electrode 317, a third insulating layer 319, a second EL photoemissive layer 321, a fourth insulating layer 323, and a third transparent electrode 325 which are sequentially arranged on the second surface of the glass base plate 303. The members 317, 319, 32 1, 323, and 325 compose a second EL element or a first EL display section 315.

The EL display 301 indicates an image on the side thereof which is close to the third transparent electrode 325. The first EL photoemissive layer 309 and the second EL photoemissive layer 321 are subjected to ac electric fields of opposite polarities but substantially equal amplitudes respectively, and thus noise is effectively suppressed as in the embodiment of FIGS. 4–7.

Figure 9:
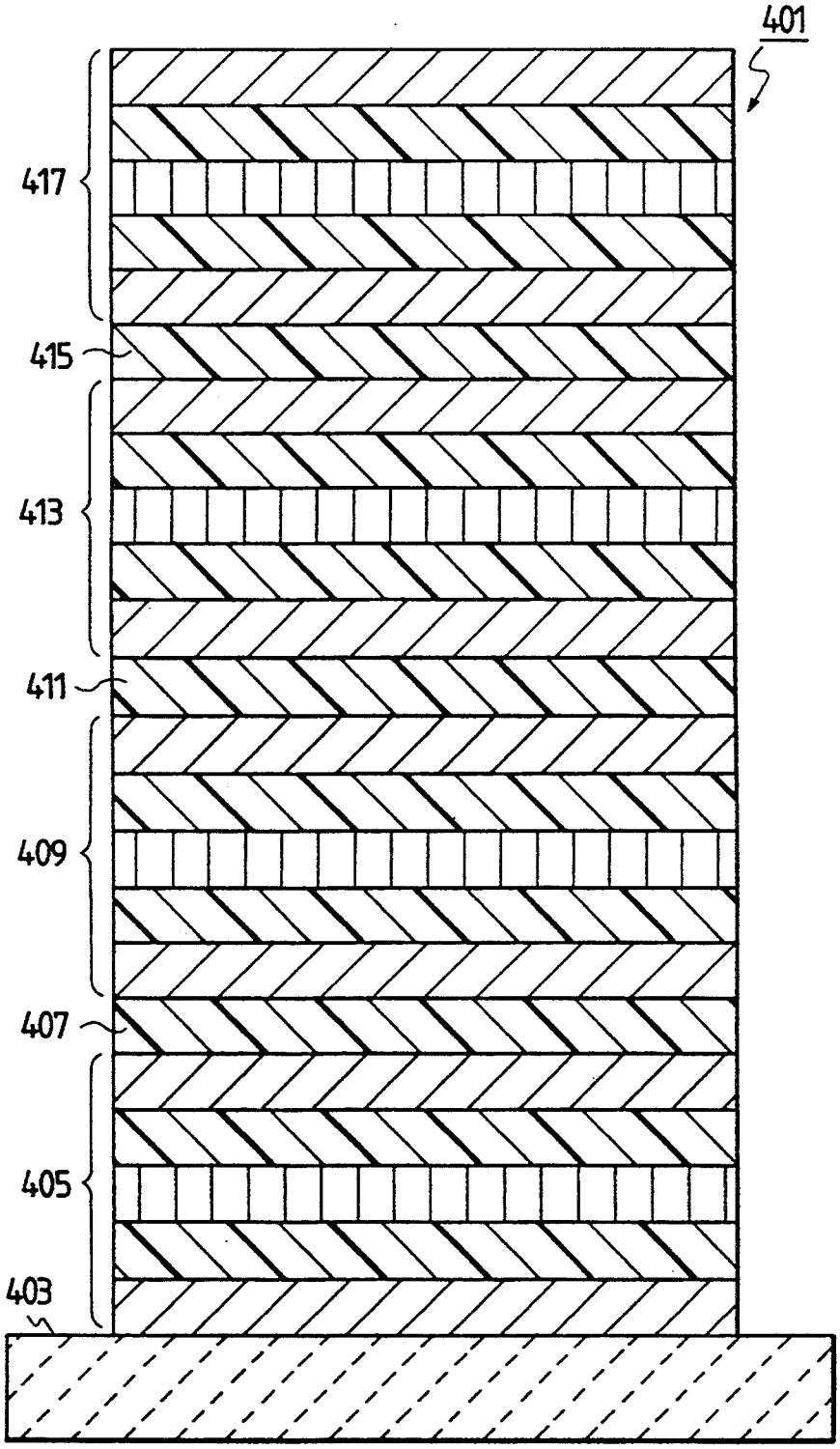
FIG. 9 is a sectional view of an EL display according to a fourth embodiment of this invention.

With reference to FIG. 9, an EL display 401 includes a glass substrate or a glass base plate 403, and a laminated structure formed on the glass base plate 403. The laminated structure has a first EL element 405, a first insulating layer 407, a second EL element 409, a second insulating layer 411, a third EL element 413, a third insulating layer 415, and a fourth EL element 417 which are sequentially arranged on the glass base plate 403. Each of the EL elements 405, 409, and 413 has a transparent electrode, an insulating layer, an EL photoemissive layer, another insulating layer, and another transparent electrode which are arranged in that order. The fourth EL element 417 has a transparent electrode, an insulating layer, an EL photoemissive layer, another insulating layer, and a back electrode which are arranged in that order.

Two of the EL photoemissive layers of the EL elements 405, 409, 413, and 417 are subjected to first electric fields of equal polarities while the other two are subjected to second electric fields of polarities opposite polarities to the polarities of the first electric fields. For example, the EL photoemissive layers of the EL elements 405 and 413 are subjected to first electric fields of the same polarities while the EL photoemissive layers of the EL elements 409 and 417 are subjected to second electric fields of opposite polarities to the polarities of the first electric fields. In the EL display 401, noise is effectively suppressed as in the embodiment of FIGS. 4–7. In addition, the intensity of emitted light can be adjusted by changing the number of the activated EL elements.

Figure 10:
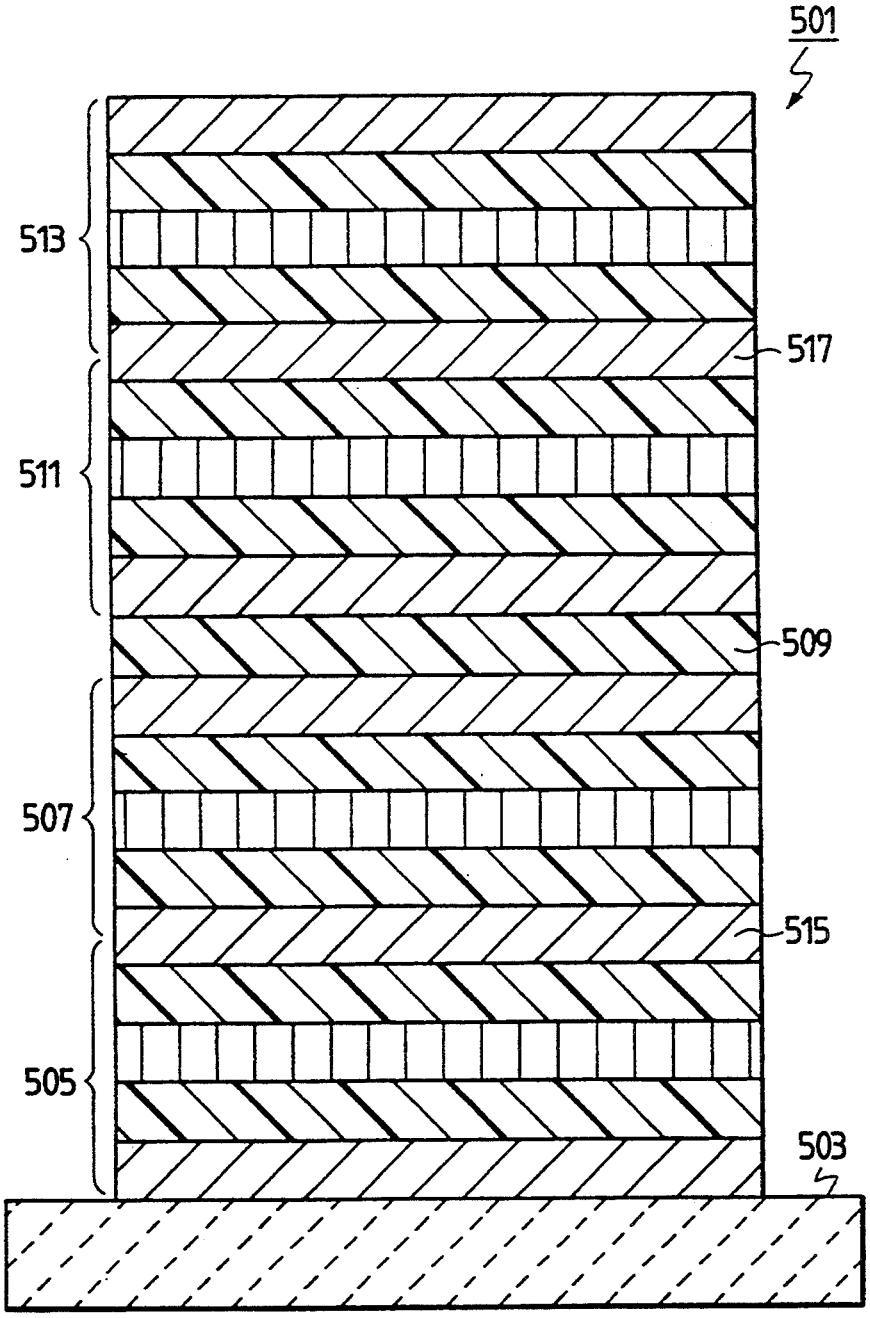
FIG. 10 is a sectional view of an EL display according to a fifth embodiment of this invention.

With reference to FIG. 10, an EL display 501 includes a glass substrate or a glass base plate 503, and a laminated structure formed on the glass base plate 503. The laminated structure has a first EL element 505, a second EL element 507, an insulating layer 509, a third EL element 511, and a fourth EL element 513 which are sequentially arranged on the glass base plate 503. Each of the EL elements 505, 507, and 511 has a transparent electrode, an insulating layer, an EL photoemissive layer, another insulating layer, and another transparent electrode which are arranged in that order. The fourth EL element 513 has a transparent electrode, an insulating layer, an EL photoemissive layer, another insulating layer, and a back electrode which are arranged in that order.

A transparent electrode 515 extending at the boundary between the first EL element 505 and the second EL element 507 is used in common by the first EL element 505 and the second EL element 507 as in the embodiment of FIGS. 1–4. In addition, a transparent electrode 517 extending at the boundary between the third EL element 511 and the fourth EL element 513 is used in common by the third EL element 511 and the fourth EL element 513 as in the embodiment of FIGS. 1–4.

Figure 11:
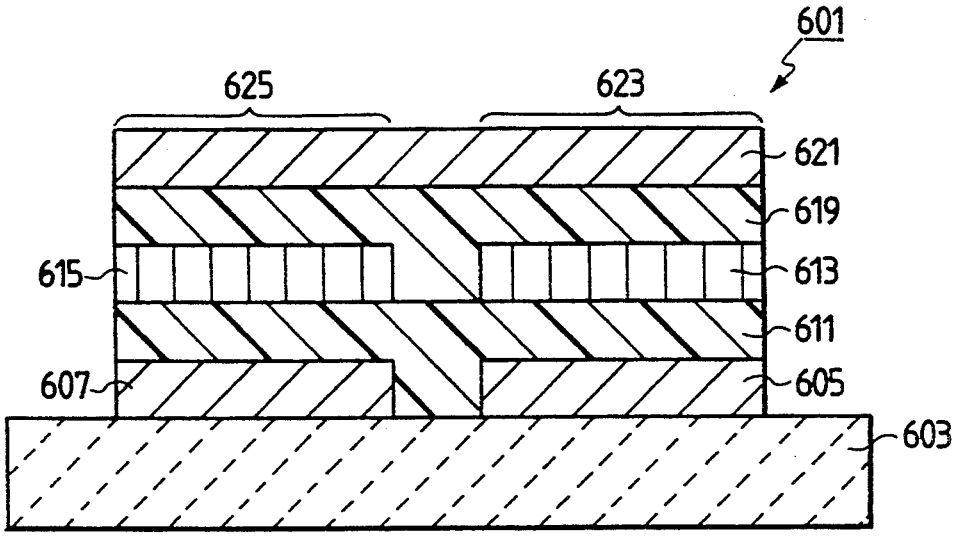
FIG. 11 is a sectional view of an EL display according to a sixth embodiment of this invention.

With reference to FIG. 11, an EL display 601 includes a glass substrate or a glass base plate 603, and first and second transparent electrodes 605 and 607 formed on separate regions of a surface of the glass base plate 603 respectively. The first and second transparent electrodes 605 and 607 are separated by a given distance. A first insulating layer 611 is formed on the first transparent electrode 605, the second transparent electrode 607, and the exposed area of the glass base plate 603 which extends between the first and second transparent electrodes 605 and 607.

First and second EL photoemissive layers 613 and 615 are formed on separate regions of a surface of the first insulating layer 611 respectively. The first and second EL photoemissive layers 613 and 615 are separated by a given distance. The first EL photoemissive layer 613 is aligned with the first transparent electrode 605. The second EL photoemissive layer 615 is aligned with the second transparent electrode 607. A second insulating layer 619 is formed on the first EL photoemissive layer 613, the second EL photoemissive layer 615, and the exposed area of the first insulating layer 611 which extends between the first and second EL photoemissive layers 613 and 615. A back electrode 62 1 is formed on a surface of the second insulating layer 619.

The first transparent electrode 605 is connected to a voltage feed circuit (not shown) similar to the voltage feed circuit 31 of FIG. 2. The second transparent electrode 607 is connected to a ground electrode (not shown), and is thus grounded. The back electrode 2 1 is electrically open, being in a no-connection state. The voltage feed circuit is designed so as to supply the first transparent electrode 605 with an ac drive voltage equal to twice a threshold value (a photoemission starting voltage related to the first and second EL photoemissive layers 613 and 615).

The first transparent electrode 605, the first insulating layer 611, the first EL photoemissive layer 6 13, the second insulating layer 619, and the back electrode 621 compose a first EL element 623. The second transparent electrode 607, the first insulating layer 611, the second EL photoemissive layer 615, the second insulating layer 619, and the back electrode 621 compose a second EL element 625.

The EL display 601 operates as follows. The voltage feed circuit applies an ac drive voltage between the first transparent electrode 605 and the second transparent electrode 607. The back electrode 621 is subjected to a potential which is equal to an intermediate value between the potentials of the first transparent electrode 605 and the second transparent electrode 607. Accordingly, the first EL photoemissive layer 613 and the second. EL photoemissive layer 615 are subjected to ac electric fields which have opposite polarities. Thus, in the EL display 601, noise is effectively suppressed.

While the back electrode 621 is electrically open and the ac drive voltage is applied between the first transparent electrode 605 and the second transparent electrode 607 in this embodiment, a modification may be done such that a first ac drive voltage is applied between the first transparent electrode 605 and the back electrode 621 and a second ac drive voltage is applied between the second transparent electrode 607 and the back electrode 621.

A seventh embodiment of this invention is similar to the embodiment of FIG. 11 except for design changes indicated hereinafter.

Figure 12:
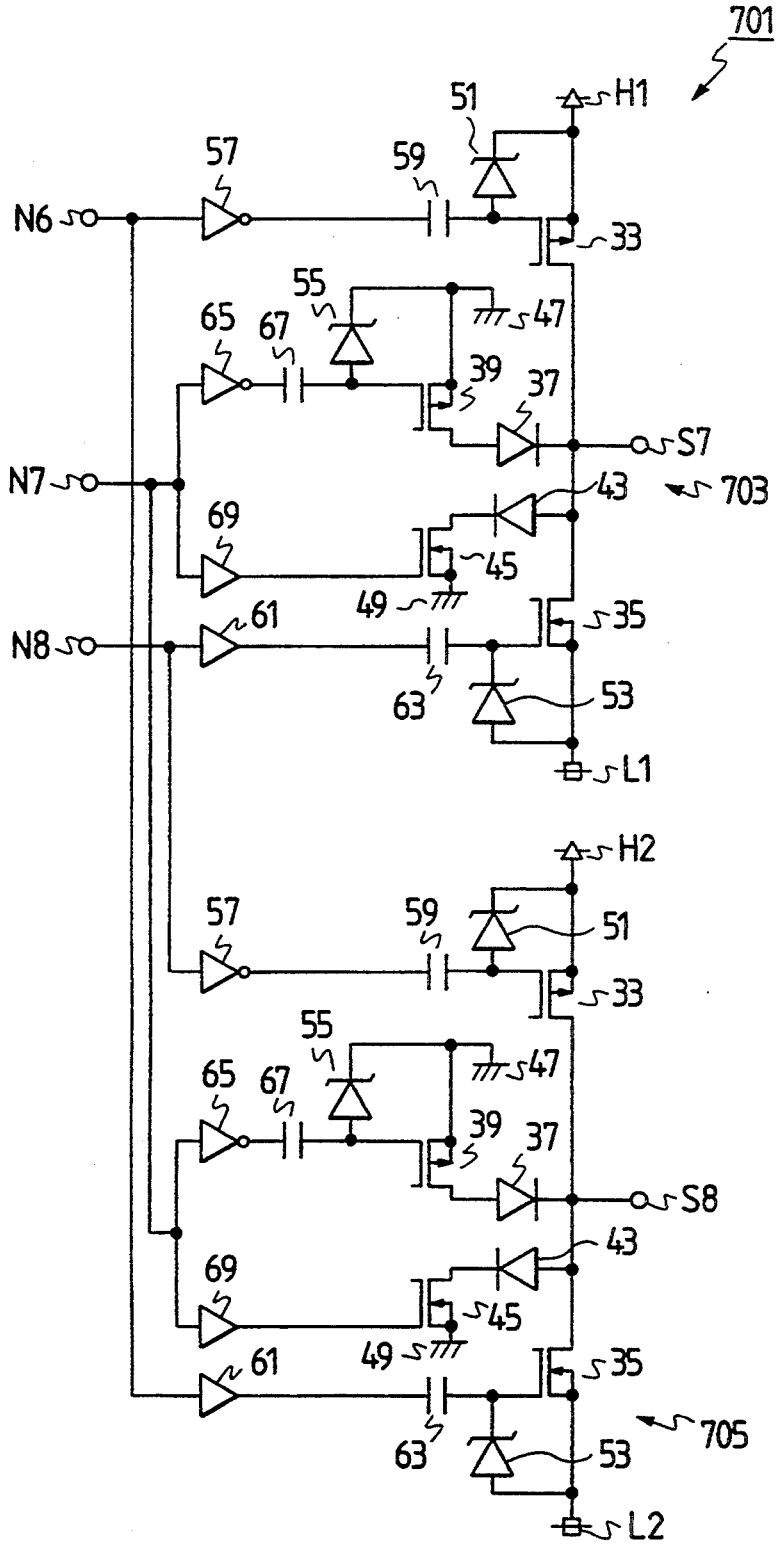
FIG. 12 is a schematic diagram of a voltage feed circuit in a seventh embodiment of this invention.

With reference to FIG. 12, a voltage feed circuit 701 of the seventh embodiment includes output terminals S7 and S8. A back electrode 621 (see FIG. 11) is connected to a ground electrode, and is thus grounded. A first transparent electrode 605 (see FIG. 11) is connected to the output terminal S7 of the voltage feed circuit 701. A second transparent electrode 607 (see FIG. 11) is connected to the output terminal S8 of the voltage feed circuit 70 1.

The voltage feed circuit 701 includes input terminals N6, N7, and N8, and circuit sections 703 and 705. The circuit section 703 is connected among the input terminals N6, N7, and N8, and the output terminal S7. The circuit section 705 is connected among the input terminals N6, N7, and N8, and the output terminal S8.

The circuit section 703 is similar to the voltage feed circuit 31 of FIG. 2 except for the following points. In the circuit section 703, the input terminal N6 is connected to an inverter 57, and the input terminal N7 is connected to an inverter 65 and a driver or a buffer 69 and the input terminal N8 is connected to a driver or a buffer 61. The output terminal S7 is connected to the drains of FET's 33 and 35.

The circuit section 705 is similar to the voltage feed circuit 31 of FIG. 2 except for the following points. In the circuit section 705, the input terminal N8 is connected to an inverter 57, and the input terminal N7 is connected to an inverter 65 and a driver or a buffer 69 and the input terminal N6 is connected to a driver or a buffer 61. The output terminal S8 is connected to the drains of FET's 33 and 35. The source of the FET 33 is connected to a high voltage electrode H2. The source of the FET 35 is connected to a low voltage electrode L2.

Figure 13:
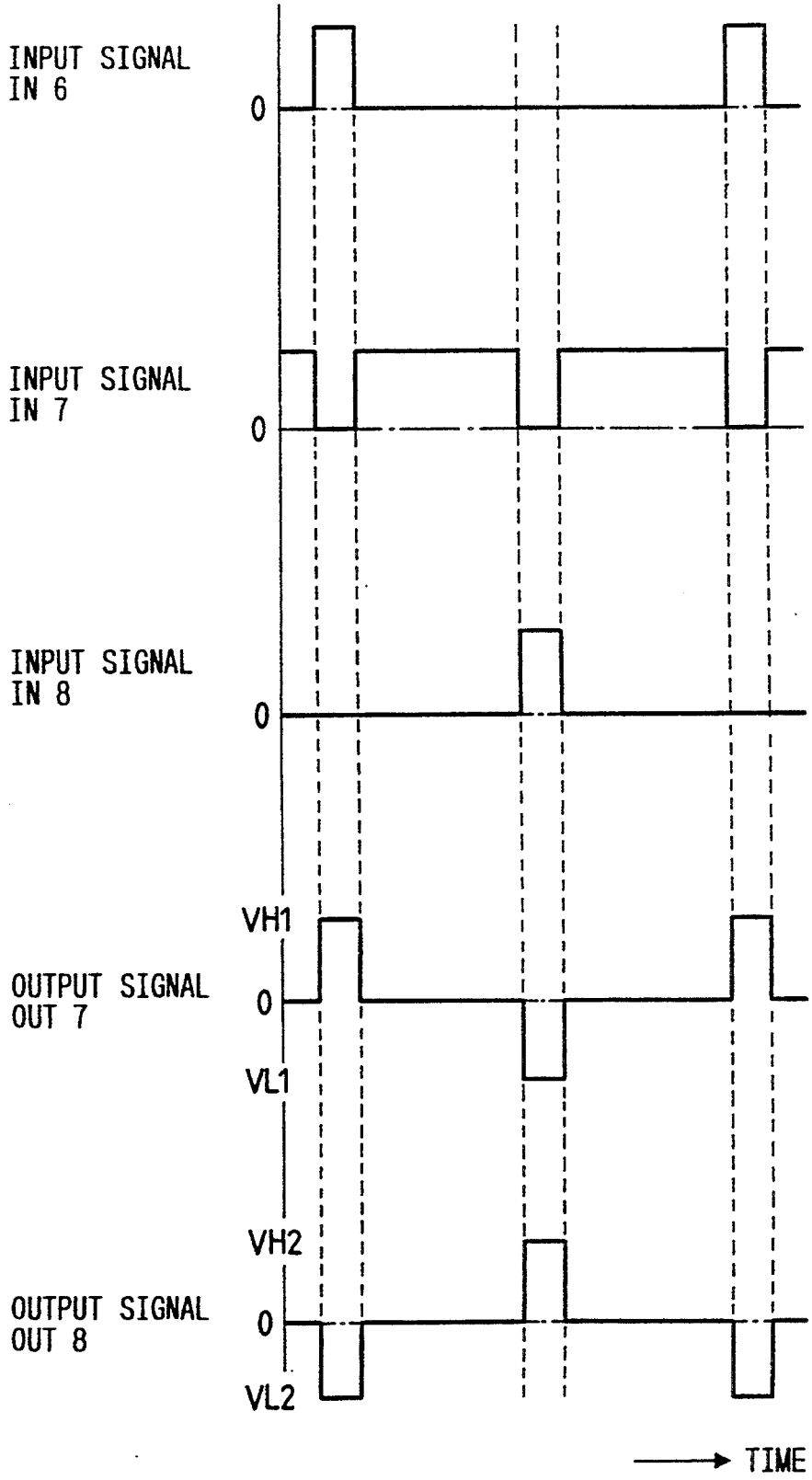
FIG. 13 is a timing chart showing the waveforms of signals inputted into and outputted from the voltage feed circuit of FIG. 12.

The voltage feed circuit 701 operates as follows. The input terminals N6, N7, and N8 receive control signals (input signals) IN6, IN7, and IN8 from a C-MOS logic IC respectively. As shown in FIG. 13, the input signals IN6, IN7, and IN8 are binary signals which can change between a high level and a low level. The voltage feed circuit 701 generates drive signals in response to the input signals IN6, IN7, and IN8, and outputs the drive signals via the output terminals S7 and S8 respectively. The drive signals outputted via the output terminals S7 and S8 are referred to as output signals OUT7 and OUT8 respectively. As shown in FIG. 13, the output signal OUT7 has a rectangular waveform including a train of alternate pulses of a high voltage VH1 and a low voltage VL1. Also, the output signal OUT8 has a rectangular waveform including a train of alternate pulses of a high voltage VH2 and a low voltage VL2. The input signals IN6 and IN8 are exchanged in the circuit section 705 relative to the circuit section 703, and a high voltage VH2 at an electrode H2 is used instead of a high voltage VH1 at an electrode H1 while a low voltage VL2 at an electrode L2 is used instead of a low voltage VL1 at an electrode L1 in the circuit section 705. According to this relation between the circuit sections 703 and 705, the output signals OUT7 and OUT8 have opposite polarities, i.e., are out of phase by 180 degrees).

Under conditions where VH1=−VL1=VH2=−VL2, a first EL photoemissive layer 613 (see FIG. 11) and a second EL photoemissive layer 615 (see FIG. 11) are subjected to ac electric fields which have equal amplitudes but opposite phases respectively. Thus, noise is effectively suppressed.

Figure 14:
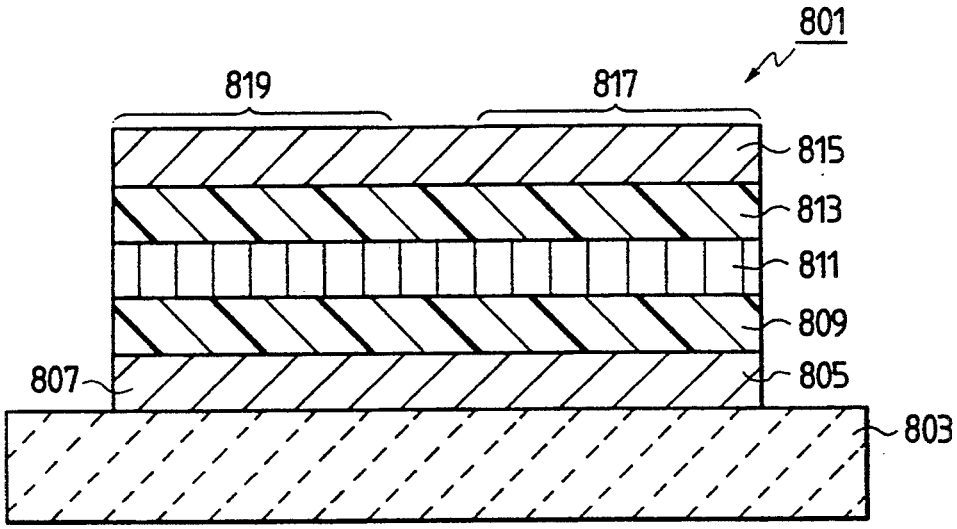
FIG. 14 is a sectional view of an EL display according to an eighth embodiment of this invention.

FIG. 14 shows an eighth embodiment of this invention which is similar to the embodiment of FIG. 11 except for design changes indicated hereinafter.

With reference to FIG. 14, an EL display 801 includes a glass substrate or a glass base plate 803, and first and second transparent electrodes 805 and 807 formed on separate regions of a surface of the glass base plate 803 respectively. The first and second transparent electrodes 805 and 807 are separated by a given distance. A first insulating layer 809 is formed on the first transparent electrode 805, the second transparent electrode 807, and the exposed area of the glass base plate 803 which extends between the first and second transparent electrodes 805 and 807. An EL photoemissive layers 811 is formed on the first insulating layer 809. A second insulating layer 813 and a back electrode 815 are sequentially formed on the EL photoemissive layer 811.

The first transparent electrode 805, the first insulating layer 809, the EL photoemissive layer 811, the second insulating layer 813, and the back electrode 815 compose a first EL element 817. The second transparent electrode 807, the first insulating layer 809, the EL photoemissive layer 811, the second insulating layer 813, and the back electrode 815 compose a second EL element 819. The first and second EL elements 817 and 819 adjoin in a direction parallel to the plane of the glass base plate 803.

Figure 15:
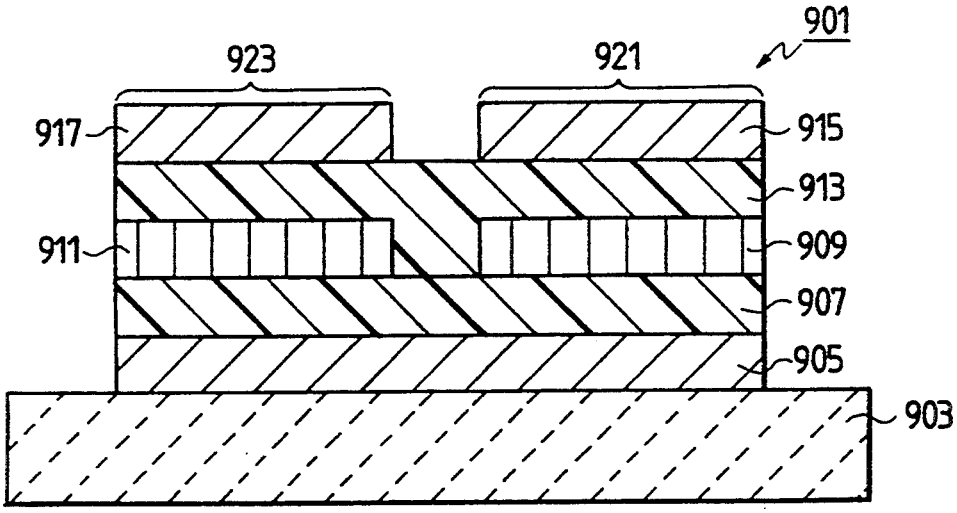
FIG. 15 is a sectional view of an EL display according to a ninth embodiment of this invention.

FIG. 15 shows a ninth embodiment of this invention which is similar to the embodiment of FIG. 11 except for design changes indicated hereinafter.

With reference to FIG. 15, an EL display 901 includes a glass substrate or a glass base plate 903, and a transparent electrodes 905 formed on the glass base plate 903. A first insulating layer 907 is formed on the transparent electrode 905. First and second EL photoemissive layers 909 and 911 are formed on separate regions of a surface of the first insulating layer 907 respectively. The first and second EL photoemissive layers 909 and 911 are separated by a given distance. A second insulating layer 913 is formed on the first EL photoemissive layer 909, the second EL photoemissive layer 911, and the exposed area of the first insulating layer 907 which extends between the first and second EL photoemissive layers 909 and 911. First and second back electrodes 915 and 917 are formed on separate regions of a surface of the second insulating layer 913 respectively. The first and second back electrodes 915 and 917 are separated by a given distance. The first back electrode 915 is aligned with the first EL photoemissive layer 909. The second back electrode 917 is aligned with the second EL photoemissive layer 911.

The transparent electrode 905, the first insulating layer 907, the first EL photoemissive layer 909, the second insulating layer 913, and the first back electrode 915 compose a first EL element 921. The transparent electrode 905, the first insulating layer 907, the second EL photoemissive layer 911, the second insulating layer 913, and the second back electrode 917 compose a second EL element 923. The first and second EL elements 921 and 923 adjoin in a direction parallel to the plane of the glass base plate 903.

Figure 16:
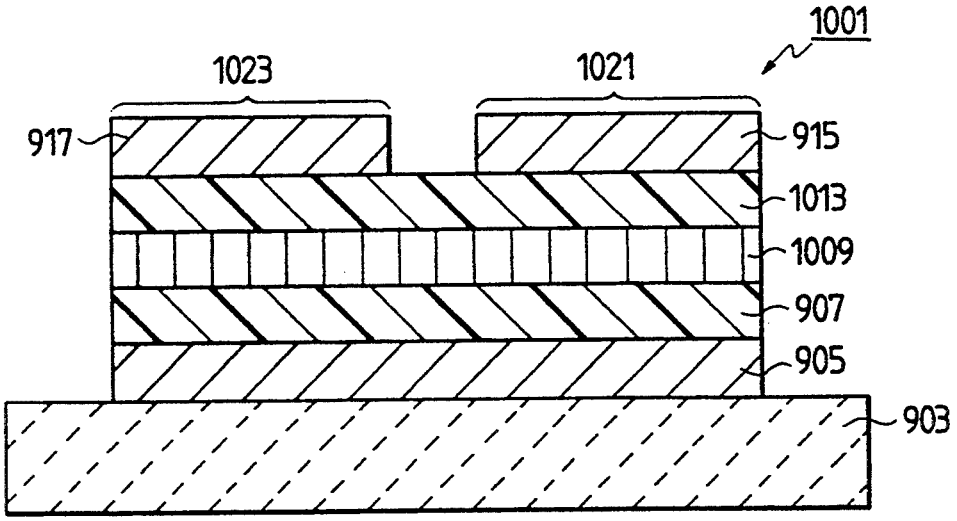
FIG. 16 is a sectional view of an EL display according to a tenth embodiment of this invention.

FIG. 16 shows a tenth embodiment of this invention which is similar to the embodiment of FIG. 15 except for design changes indicated hereinafter.

With reference to FIG. 16, an EL display 1001 includes an EL photoemissive layer 1009 formed on a first insulating layer 907. A second insulating layer 10 13 is formed on the EL photoemissive layer 1009. First and second back electrodes 915 and 917 are formed on separate regions of a surface of the second insulating layer 1013 respectively.

The transparent electrode 905, the first insulating layer 907, the EL photoemissive layer 1009, the second insulating layer 1013, and the first back electrode 9 15 compose a first EL element 1021. The transparent electrode 905, the first insulating layer 907, the EL photoemissive layer 1009, the second insulating layer 1013, and the second back electrode 917 compose a second EL element 1023.

Figure 17:
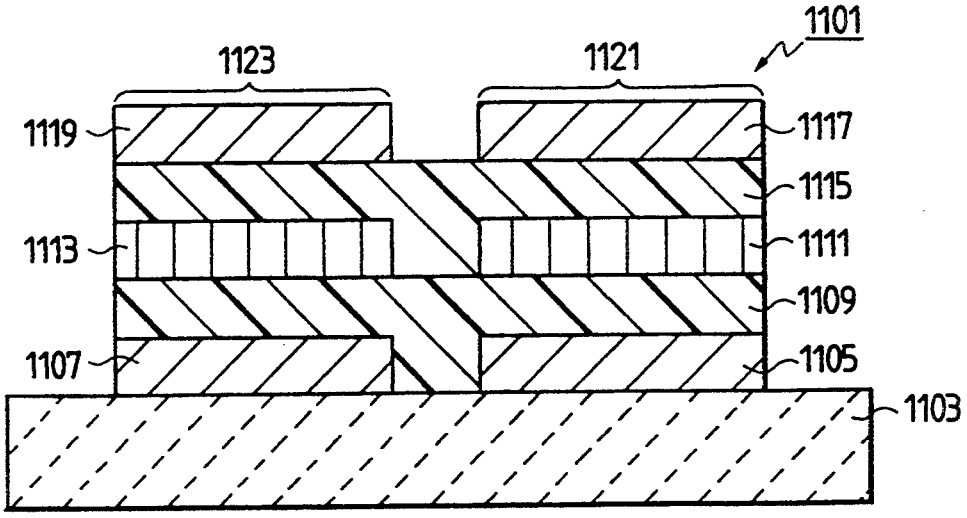
FIG. 17 is a sectional view of an EL display according to an eleventh embodiment of this invention.

With reference to FIG. 17, an EL display 1101 includes a glass substrate or a glass base plate 1103, and first and second transparent electrodes 1105 and 1107 formed on separate regions of a surface of the glass base plate 1103 respectively. The first and second transparent electrodes 1105 and 1107 are separated by a given distance. A first insulating layer 1109 is formed on the first transparent electrode 1105, the second transparent electrode 1107, and the exposed area of the glass base plate 1103 which extends between the first and second transparent electrodes 1105 and 1107.

First and second EL photoemissive layers 1111 and 1113 are formed on separate regions of a surface of the first insulating layer 1109 respectively. The first and second EL photoemissive layers 1111 and 1113 are separated by a given distance. The first EL photoemissive layer 1111 is aligned with the first transparent electrode 1105. The second EL photoemissive layer 1113 is aligned with the second transparent electrode 1107. A second insulating layer 1115 is formed on the first EL photoemissive layer 1111, the second EL photoemissive layer 1113, and the exposed area of the first insulating layer 1109 which extends between the first and second EL photoemissive layers 1111 and 1113.

First and second back electrodes 1117 and 1119 are formed on separate regions of a surface of the second insulating layer 1115 respectively. The first and second back electrodes 1117 and 1119 are separated by a given distance. The first back electrode 1117 is aligned with the first EL photoemissive layer 1111. The second back electrode 1119 is aligned with the second EL photoemissive layer 1113.

Figure 18:
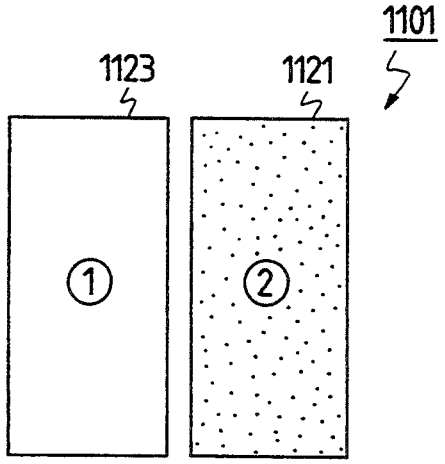
FIG. 18 is a plan view of the EL display in FIG. 17.

The first transparent electrode 1105, the first insulating layer 1109, the first EL photoemissive layer 1111, the second insulating layer 1115, and the first back electrode 1117 compose a first EL element 1121. The second transparent electrode 1107, the first insulating layer 1109, the second EL photoemissive layer 1113, the second insulating layer 1115, and the second back electrode 1119 compose a second EL element 1123. As shown in FIGS. 17 and 18, the first and second EL elements 1121 and 1123 adjoin in a direction parallel to the plane of the glass base plate 1103.

The first transparent electrode 1105 is connected to the output terminal S3 of a voltage feed circuit 231 (see FIG. 6). The first back electrode 1117 is connected to the output terminal S4 of the voltage feed circuit 23 1 (see FIG. 6). The second transparent electrode 1107 is connected to the output terminal S5 of the voltage feed circuit 231 (see FIG. 6). The second back electrode 1119 is connected to the output terminal S6 of the voltage feed circuit 231 (see FIG. 6).

In FIG. 18, the regions denoted by the characters ① and ② are subjected to opposite electric fields respectively. Accordingly, the first EL photoemissive layer 1111 and the second EL photoemissive layer 1113 are subjected to ac electric fields of opposite phases respectively, and thus noise is effectively suppressed.

Figure 19:
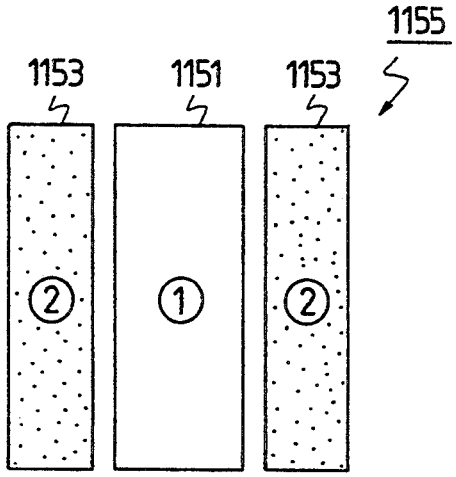
FIG. 19 is a plan view of an EL display according to a twelfth embodiment of this invention.

FIG. 19 shows a twelfth embodiment of this invention which is similar to the embodiment of FIGS. 17 and 18 except for design changes indicated hereinafter.

With reference to FIG. 19, an EL display 1155 includes a rectangular EL element 115 1. A pair of rectangular EL elements 1153 are located at opposite sides of the EL element 115 1. The width of the EL elements 1153 is equal to about a half of the width of the EL element 1151. The area of the EL element 1151 is approximately equal to the sum of the areas of the EL elements 1153.

In FIG. 19, the regions denoted by the characters ① and ② are subjected to opposite electric fields respectively. Accordingly, an EL photoemissive layer of the EL element 1151 and EL photoemissive layers of the EL elements 1153 are subjected to ac electric fields of opposite polarities, and thus noise is effectively suppressed.

Figure 20:
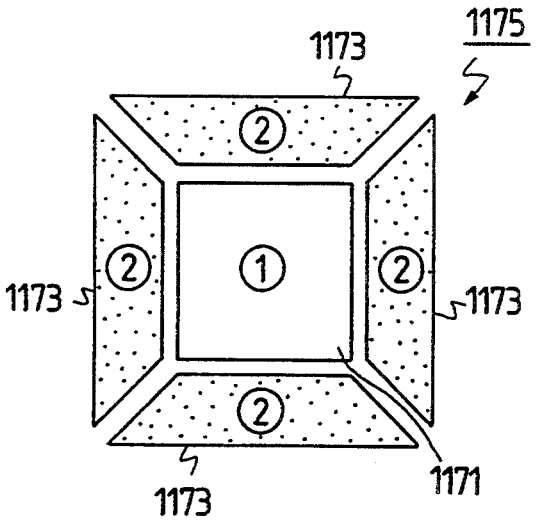
FIG. 20 is a plan view of an EL display according to a thirteenth embodiment of this invention.

FIG. 20 shows a thirteenth embodiment of this invention which is similar to the embodiment of FIGS. 17 and 18 except for design changes indicated hereinafter.

With reference to FIG. 20, an EL display 1175 includes a square EL element 1171. Four trapezoidal EL elements 1173 are located in regions close to sides of the EL element 1171 respectively. The area of the EL elements 1173 is equal to about a quarter of the area of the EL element 1171.

In FIG. 20, the regions denoted by the characters ① and ② are subjected to opposite electric fields respectively. Accordingly, an EL photoemissive layer of the EL element 1171 and EL photoemissive layers of the EL elements 1173 are subjected to ac electric fields of opposite polarities, and thus noise is effectively suppressed.

Figure 21:
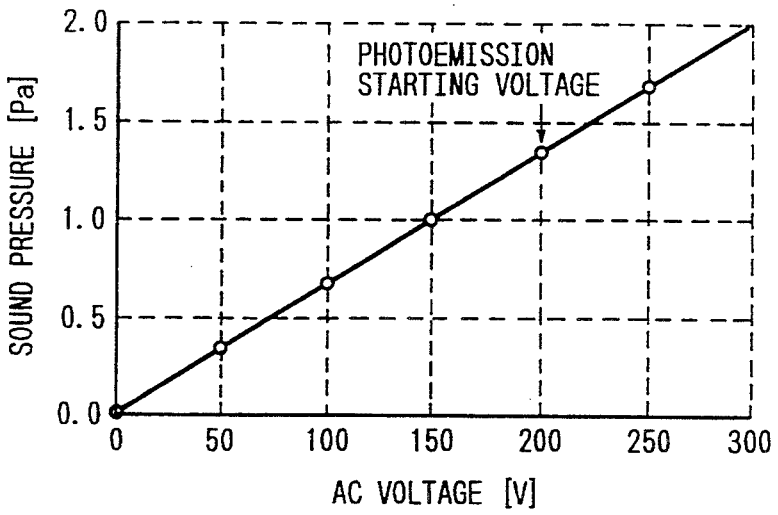
FIG. 21 is a diagram showing the relation between an ac drive voltage applied to an EL element and a sound pressure.

A description will now be given of a general EL element. In the general EL element, as shown in FIG. 21, the magnitude of a sound pressure related to noise increases in proportion to the magnitude of an ac drive voltage. The general EL element does not emit light when the ac drive voltage is lower than a threshold level (a photoemission starting voltage). On the other hand, the general EL element emits light when the ac drive voltage is equal to or higher than the threshold level (the photoemission starting voltage).

Thus, the general EL element changes among three different driven states in accordance with a variation in the ac drive voltage. When the ac drive voltage is continuously equal to 0 volt, the general EL element falls in the first driven state where both vibration-noise generation and photoemission are absent. When the ac drive voltage is between 0 volt and the threshold level (the photoemission starting voltage), the general EL element falls in the second driven state where photoemission is absent but vibration-noise generation is present. When the ac drive voltage is equal to or higher than the threshold level (the photoemission starting voltage), the general EL element falls in the third driven state where both vibration-noise generation and photoemission are present.

It is now assumed that there are first and second ac drive voltages having opposite polarities, i.e., being out of phase by 180 degrees. The first ac drive voltage is defined as a normal ac drive voltage while the second ac drive voltage is defined as an inverted ac drive voltage. In the case where the normal ac drive voltage is applied to the general EL element, the general EL element changes among three different driven states ⑤, ③, and ① corresponding to the previously-mentioned first, second, and third driven states respectively. In the case where the inverted ac drive voltage is applied to the general EL element, the general EL element changes among three different driven states ⑤, ④, and ② corresponding to the previously-mentioned first, second, and third driven states respectively. Thus, under conditions where there are the normal ac drive voltage and the inverted ac drive voltage, the general EL element can assume the five different driven states ①, ②, ③, ④, and ⑤.

Figure 22:
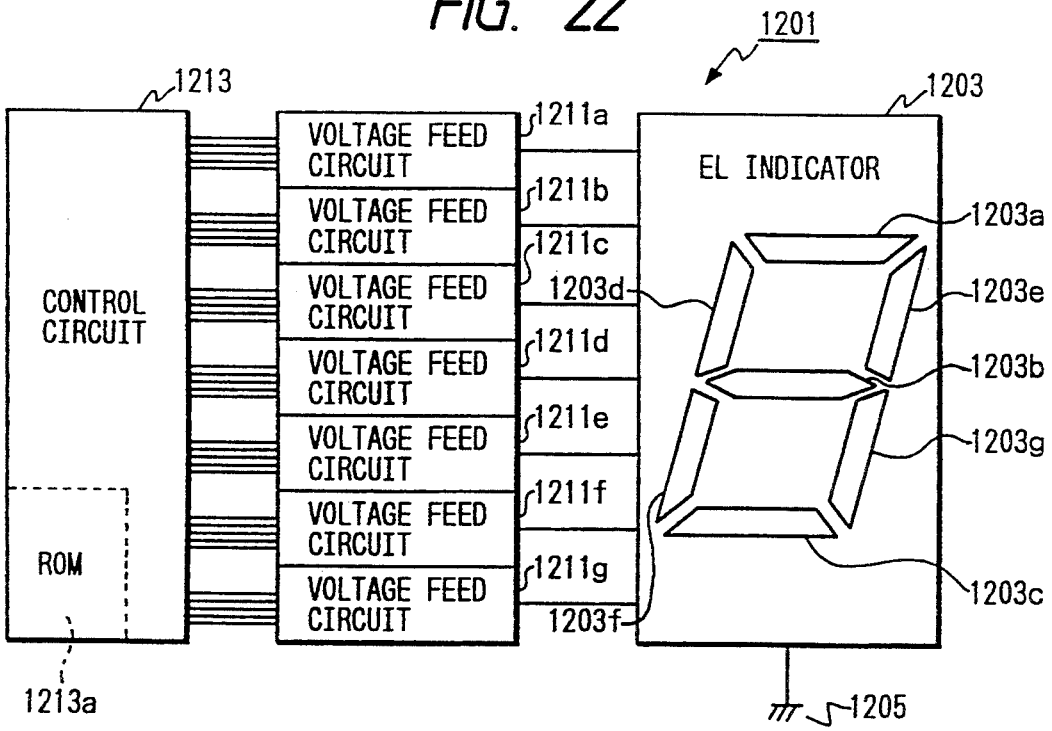
FIG. 22 is a diagram of an EL display according to a fourteenth embodiment of this invention.

A fourteenth embodiment will now be described. With reference to FIG. 22, an EL display 1201 includes a seven-segment EL display section or a seven-segment EL indicator 1203 which has three transversely (horizontally) elongated transparent electrodes 1203*a*, 1203*b*, and 1203*c*, and four longitudinally (vertically) elongated transparent electrodes 1203*d*, 1203*e*, 1203*f*, and 1203*g*. The transparent electrodes 1203*a*–1203*g* correspond to the respective segments of the EL indicator 1203. The transparent electrodes 1203*a*–1203*g* are connected to a ground electrode 1205, and are thus grounded. An EL photoemissive layer is provided between a back electrode (not shown) and an array of the transparent electrodes 1203*a*–1203*g*.

The transparent electrodes 1203*a*, 1203*b*, 1203*c*, 1203*d*, 1203*e*, 1203*f*, and 1203*g* are connected to voltage feed circuits 1211*a*, 1211*b*, 1211*c*, 1211*d*, 1211e, 1211*f*, and 1211*g* respectively. The voltage feed circuits 121 1*a*–1211*g* generate ac drive voltages in response to control signals fed from a control circuit 1213, and apply the generated ac drive voltages to the transparent electrodes 1203*a*–1203*g* respectively. Each of the ac drive voltages can assume five different states which provide the previously-mentioned five different driven states ①, ②, ③, ④, and ⑤ of an EL element respectively.

The control circuit 1213 includes a microcomputer having a ROM 1213*a*, a CPU, and a RAM. The ROM 1213*a* stores information of characters indicated by the EL indicator 1203, information of control signals fed to the voltage feed circuits 1211a–1211g, and the relation of correspondence between the character information and the control-signal information.

The voltage feed circuits 1211a–1211g have equal structures, and only one of them will be described in detail hereinafter with reference to FIG. 23.

Figure 23:
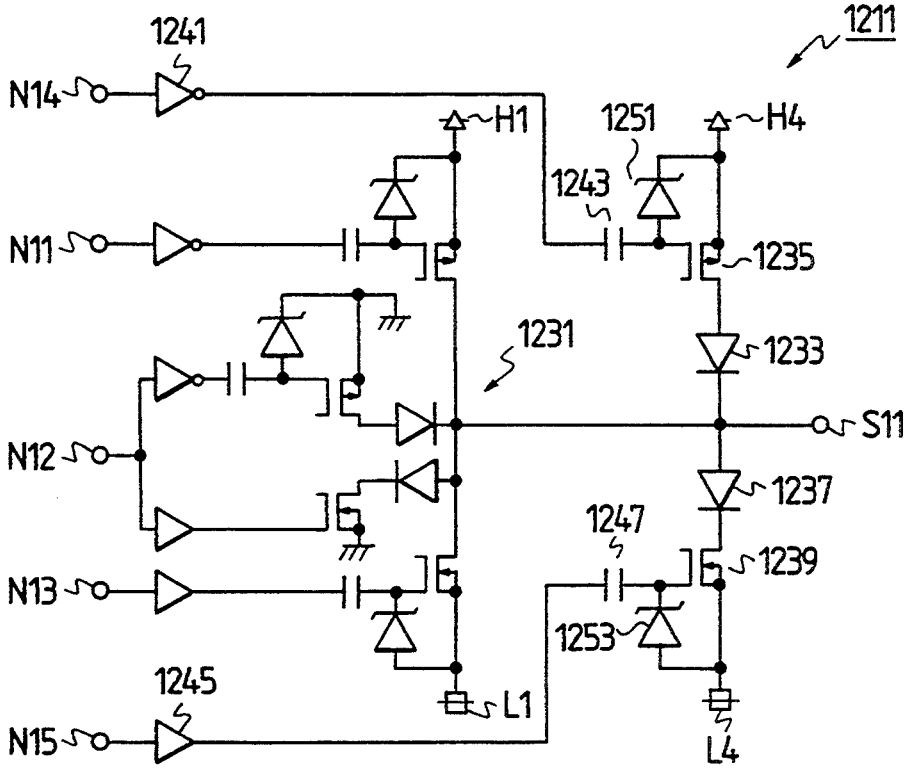
FIG. 23 is a schematic diagram of a voltage feed circuit in the fourteenth embodiment of this invention.

As shown in FIG. 23, a voltage feed circuit 12 11 includes input terminals N11, N12, and N13, and an output terminal S11. A circuit section 1231 similar to the voltage feed circuit 31 of FIG. 2 is connected among the input terminals N11, N12, and N13, and the output terminal S11. The output terminal S11 is connected to the drain of a FET 1235 via a diode 1233. The output terminal S11 is connected to the drain of a FET 1239 via a diode 1237. The polarity of the diode 1233 is chosen so as to block a current from the output terminal S11 toward the FET 1235. The polarity of the diode 1237 is chosen so as to block a current from the FET 1239 toward the output terminal S11. The source of the FET 1235 is connected to an electrode H4 subjected to a given high voltage VH4 (which is higher than a ground potential equal to 0 volt). The source of the FET 1239 is connected to an electrode L4 subjected to a given low voltage VL4 (which is lower than a ground potential equal to 0 volt).

The gate of the FET 1235 is connected to an input terminal N14 via an inverter 1241 and a dc-blocking capacitor 1243. The gate of the FET 1239 is connected to an input terminal N15 via a driver or a buffer 1245 and a dc-blocking capacitor 1247. The FET 1235 is of the p-channel type, being turned on when the gate voltage thereof assumes a low level. The FET 1239 is of the n-channel type, being turned on when the gate voltage thereof assumes a high level. A zener diode 1251 is connected between the gate and the source of the FET 1235 to protect the FET 1235. A zener diode 1253 is connected between the gate and the source of the FET 1239 to protect the FET 1239.

The high voltage VH4 at the electrode H4 is equal to about a half of a given high voltage VH1. The absolute value of the high voltage VH4 is smaller than a photoemission starting voltage (a threshold level) of the EL indicator 1203. The high voltage VL4 at the electrode L4 is equal to about a half of a given low voltage VL1. The absolute value of the low voltage VIA is smaller than the photoemission starting voltage (the threshold level) of the EL indicator 1203.

The voltage feed circuit 1211 operates as follows. When both the control signals applied to the input terminals N14 and N15 (that is, both input signals IN14 and IN15) assume low levels, the output terminal S11 is disconnected from both the high voltage electrode H4 and the low voltage electrode L4. Under these conditions, when the control signals applied to the input terminals N11, N12, and N13 (that is, input signals IN11, IN12, and IN13) are similar to the input signals IN1, IN2, and IN3 of FIG. 3, the drive signal outputted via the output terminal S11 is equal to a rectangular ac voltage which changes between the high value VH1 and the low value VL1 at a given period. This case corresponds to the previously-mentioned driven state ① of an EL element. The drive signal outputted via the output terminal S11 is referred to as an output signal OUT11. When the input signal IN11 and the input signal IN13 are exchanged, the output signal OUT11 is inverted in phase. This case corresponds to the previously-mentioned driven state ② of the EL element.

Figure 24:
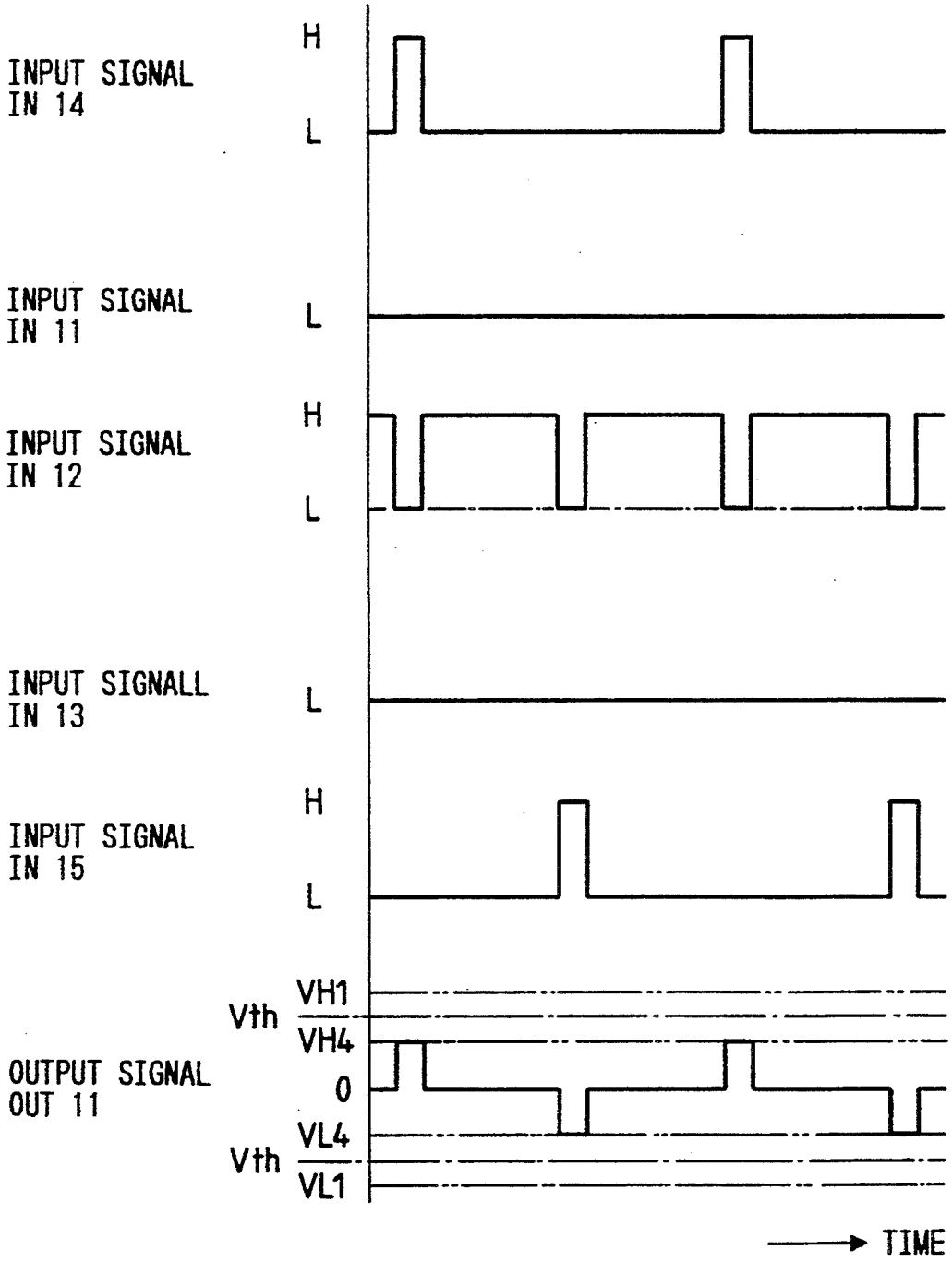
FIG. 24 is a timing chart showing the waveforms of signals inputted into and outputted from the voltage feed circuit of FIG. 23.

When both the control signals applied to the input terminals N11 and N13 (that is, both input signals IN11 and IN13) assume low levels, the output terminal S11 is disconnected from both the high voltage electrode H1 and the low voltage electrode L1. Under these conditions, when the control signals applied to the input terminals N14, N12, and N15 (that is, input signals IN14, IN12, and IN15) are similar to the input signals IN1, IN2, and IN3 of FIG. 3, the drive signal outputted via the output terminal S11 (that is, the output signal OUT11) is equal to a rectangular ac voltage which changes between the high value VH4 and the low value VL4 at a given period as shown in FIG. 24. This case corresponds to the previously-mentioned driven state ③ of the EL element. When the input signal IN14 and the input signal IN15 are exchanged, the output signal OUT11 is inverted in phase. This case corresponds to the previously-mentioned driven state ④ of the EL element. Furthermore, when the input signal IN12 assumes a high level but the input signals IN11, IN13, IN14, and IN15 assume a low level, the output signal OUT11 continues to be 0 volt as shown in FIG. 24. This case corresponds to the previously-driven state ⑤ of the EL element.

Figure 25:
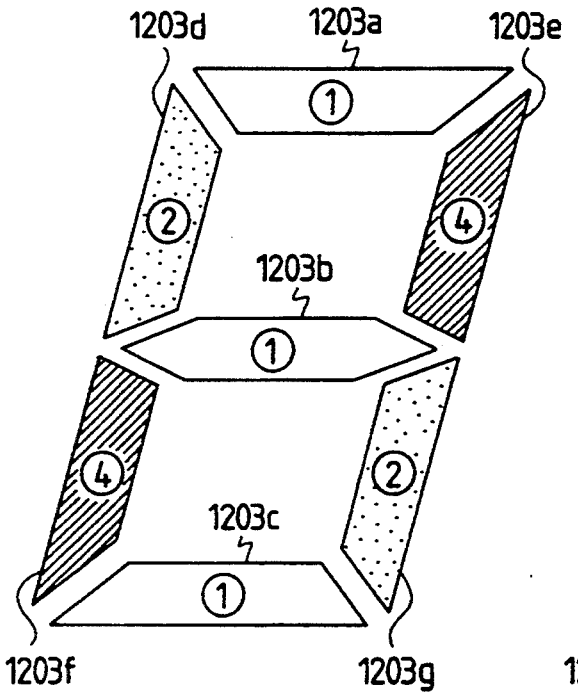
FIG. 25 and FIG. 26 are plan views of the EL indicator in the fourteenth embodiment of this invention.

In the EL display 1201, a character is indicated while noise is suppressed as will be described hereinafter. FIG. 25 shows driven states of respective segments of the EL indicator 1203 which occur when the numeral "5" is indicated by the EL indicator 1203. As shown in FIG. 25, the indicator segments corresponding to the transparent electrodes 1203a–1203c are in the driven states ① to emit light while the indicator segments corresponding to the transparent electrodes 1203d and 1203g are in the driven states ② to emit light. On the other hand, the indicator segments corresponding to the transparent electrodes 1203e and 1203f are in the driven states ④ not to emit light. Thus, the EL indicator 1203 displays the numeral "5".

The indicator segments corresponding to the transparent electrodes 1203a–1203c generate noise responsive to the normal ac drive voltage. The indicator segments corresponding to the transparent electrodes 1203d–1203g generate noise responsive to the inverted ac drive voltage. The noise related to the transparent electrodes 1203a–1203c and the noise related to the transparent electrodes 1203d–1203g have opposite phases, that is, are out of phase by 180 degrees. A sound pressure of noise related to the driven state ④ is approximately equal to a half of a sound pressure of noise related to the driven state ① or ②. Thus, in the case where the EL indicator 1203 indicates the numeral "5", the noise related to the transparent electrodes 1203a–1203c and the noise related to the transparent electrodes 1203d–1203g are approximately equal in sound pressure but are opposite in phase so that they well cancel each other. As a result, noise is effectively suppressed.

Figure 26:
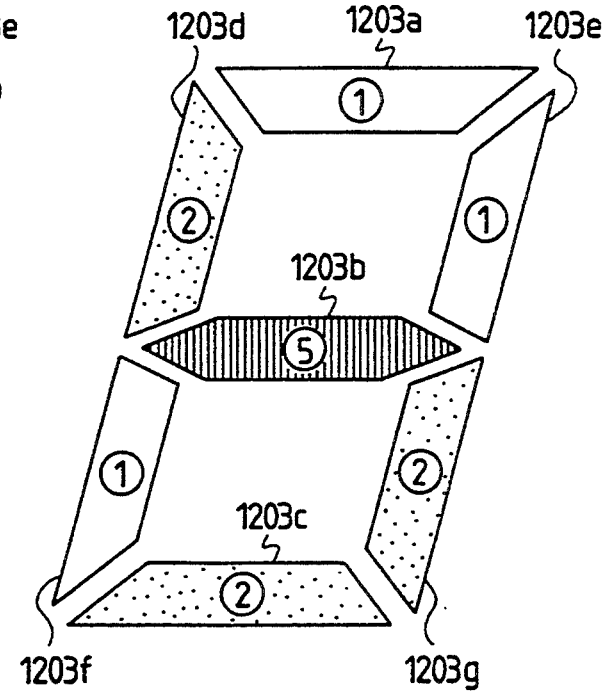

FIG. 26 shows driven states of respective segments of the EL indicator 1203 which occur when the numeral "0" is indicated by the EL indicator 1203. As shown in FIG. 26, the indicator segments corresponding to the transparent electrodes 1203a, 1203e, and 1203f are in the driven states ① to emit light while the indicator segments corresponding to the transparent electrodes 1203c, 1203d, and 1203g are in the driven states ② to emit light. On the other hand, the indicator segment corresponding to the transparent electrode 1203b is in the driven state ⑤ not to emit light and not to generate noise. Thus, the EL indicator 1203 displays the numeral "0".

The indicator segments corresponding to the transparent electrodes 1203*a*, 1203*e*, and 1203*f* generate noise responsive to the normal ac drive voltage. The indicator segments corresponding to the transparent electrodes 1203*c*, 1203*d*, and 1203*g* generate noise responsive to the inverted ac drive voltage. The noise related to the transparent electrodes 1203*a*, 1203*e*, and 1203*f* and the noise related to the transparent electrodes 1203*c*, 1203*d*, and 1203*g* are approximately equal in sound pressure but are opposite in phase. Thus, in the case where the EL indicator 1203 indicates the numeral "0", the noise related to the transparent electrodes 1203*a*, 1203*e*, and 1203*f* and the noise related to the transparent electrodes 1203*c*, 1203*d*, and 1203*g* well cancel each other. As a result, noise is effectively suppressed.

In the case of indication of numerals other than "5" and "0", the driven states ①-⑤ are suitably combined to effectively suppress noise.

Figure 27:
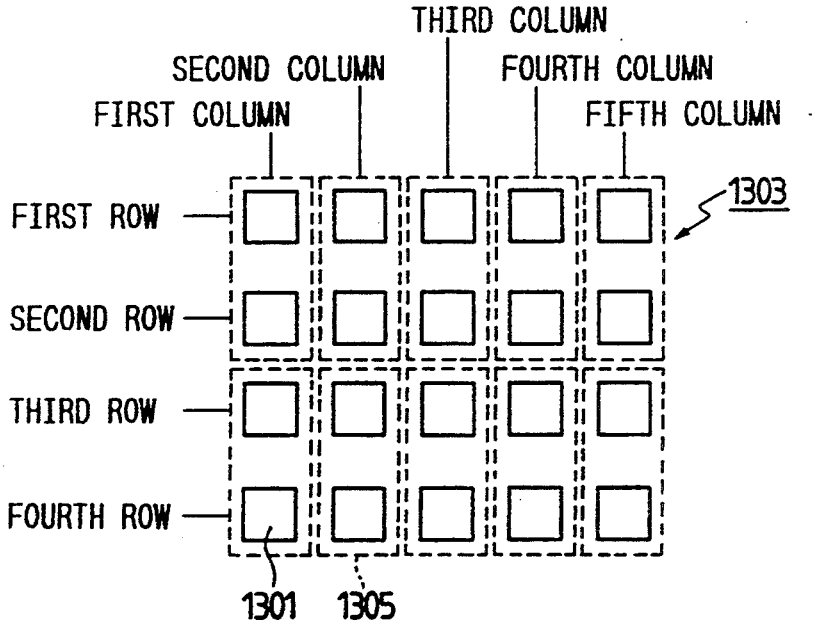
FIG. 27 is a plan view of an EL display according to a fifteenth embodiment of this invention.

With reference to FIG. 27, an EL display 1303 includes EL elements 1301 which are arranged in a matrix of four rows by five columns. The EL elements 1301 are separated into groups or blocks 1305 each having two members. Specifically, in each of the five columns, the first-row EL element and the second-row EL element compose a block 1305, and the third-row EL element and the fourth-row EL element compose a block 1305. Voltage feed circuits (not shown) control the upper and lower EL elements 1301 of each block 1305 so that they can change among driven states shown in FIG. 28.

In the case where both the upper and lower EL elements 1301 of a block 1305 emit light, the upper EL element is in the driven state ① (which is previously described regarding the embodiment of FIGS. 21–26) while the lower EL element is in the driven state ② (which is previously described regarding the embodiment of FIGS. 21–26). In the case where the upper EL element 1301 of a block 1305 emits light but the lower EL element 1301 of the block 1305 does not emit light, the upper EL element is in the driven state ① while the lower EL element is in the driven state ④ (which is previously described regarding the embodiment of FIGS. 21–26). In the case where the upper EL element 1301 of a block 1305 does not emit light but the lower EL element 1301 of the block 1305 emits light, the upper EL element is in the driven state ③ (which is previously described regarding the embodiment of FIGS. 21–26) while the lower EL element is in the driven state ②. In the case where both the upper and lower EL elements 1301 of a block 1305 do not emit light, the upper and lower EL elements are in the driven state ⑤ (which is previously described regarding the embodiment of FIGS. 21–26).

In this embodiment, the EL elements 1301 are sequentially scanned one column by one column or two rows by two rows.

As understood from the previously description, in each block 1305, noise generated by the upper EL element 1301 and noise generated by the lower EL element 1301 are opposite in polarity so that they can adequately cancel each other. Thus, in the EL display 1303, noise is effectively suppressed.

A sixteenth embodiment of this invention is a modification of the embodiments of FIGS. 1–27. The sixteenth embodiment includes three EL elements fed with ac drive voltages which are out of phase by 120 degrees. In the sixteenth embodiment, vibration generated by the first EL element, vibration generated by the second EL element, and vibration generated by the third EL element adequately cancel each other so that noise is effectively suppressed.

A seventeenth embodiment of this invention is a modification of the embodiments of FIGS. 1–27. The seventeenth embodiment includes three or more EL elements. In the seventeenth embodiment, the number of an EL element or elements fed with ac drive voltages of a first polarity is generally different from the number of an EL element or elements fed with ac drive voltages of a second polarity different from the first polarity.

Figure 29:
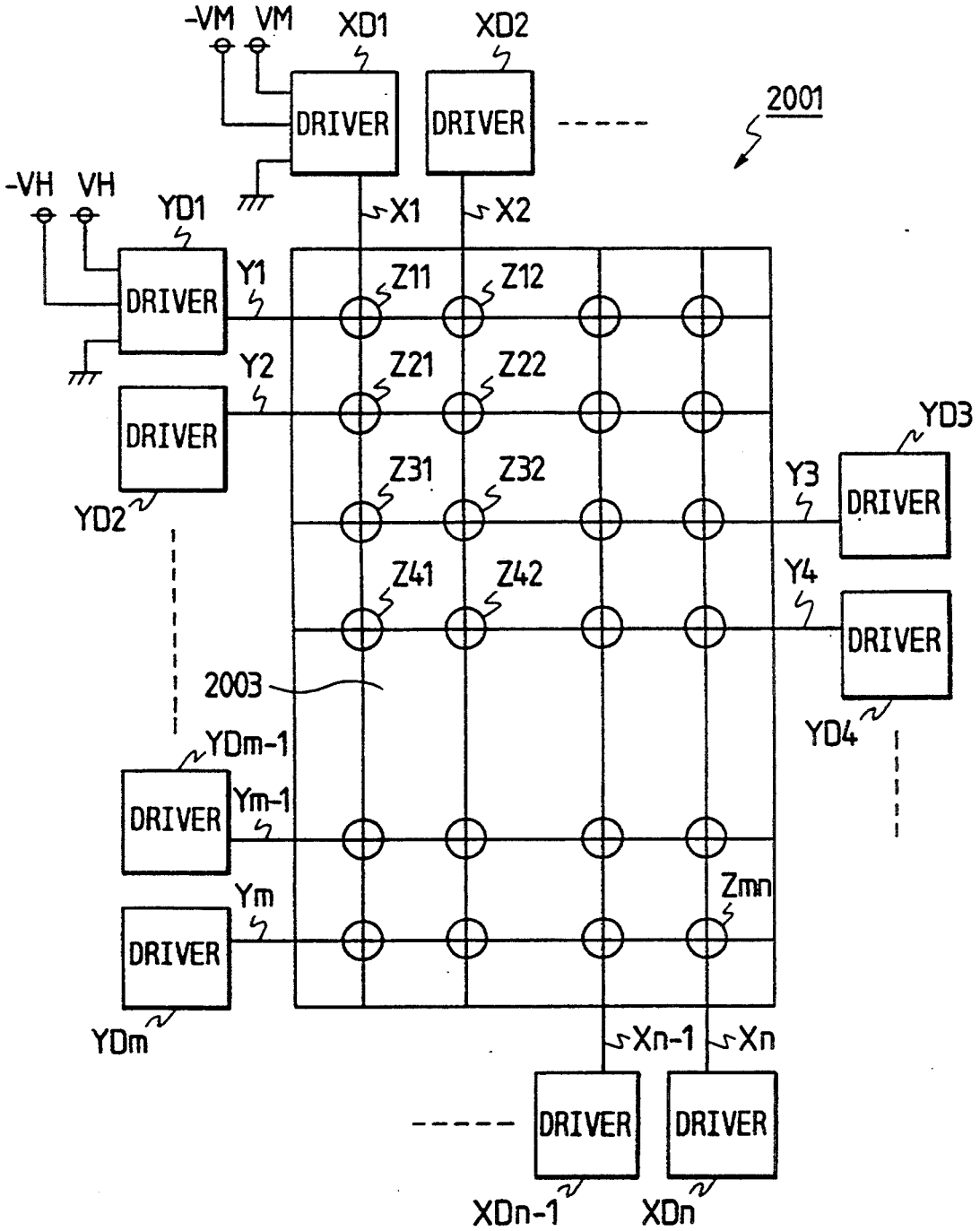
FIG. 29 is a diagram of an EL display according to an eighteenth embodiment of this invention.

With reference to FIG. 29, an EL display 2001 includes an EL photoemissive layer 2003. An m-number of parallel scanning electrodes Y1, Y2, . . . , Ym are prodded on one surface of the EL photoemissive layer 2003. Here, the letter "m" denotes a given even number. The scanning electrodes Y1–Ym correspond to rows respectively. An n-number of parallel data electrodes X1, X2, . . . , Xn are provided on the other surface of the EL photoemissive layer 2003. The data electrodes X1–Xn correspond to columns respectively. Here, the letter "n" denotes a given even number. The data electrodes X1–Xn are perpendicular to the scanning electrodes Y1–Ym. Pixels Z11, Z12, . . . , Z1n, Z21, Z22, . . . , Zmn are formed at respective intersections among the scanning electrodes Y1–Ym and the data electrodes X1–Xn.

The scanning electrodes Y1–Ym are separated into pairs each having adjacent two scanning electrodes, and the pairs project from side edges of the EL photoemissive layer 2003 alternately in opposite directions. The projecting ends of the scanning electrodes Y1, Y2, . . . , Ym are connected to scanning drivers or voltage feed circuits YD1, YD2, . . . , YDm respectively. The scanning drivers YD1–YDm generate drive signals in response to control signals fed from a control circuit (not shown). Each of the drive signals can assume either of a positive voltage VH, a negative voltage −VH, and a zero voltage 0(V).

The data electrodes X1–Xn are separated into pairs each having adjacent two data electrodes, and the pairs project from side edges of the EL photoemissive layer 2003 alternately in opposite directions. The projecting ends of the data electrodes X1, X2, . . . , Xn are connected to data drives or voltage feed circuits XD1, XD2, . . . , XDn respectively. The data drives X1–XDn generate drive signals in response to control signals fed from the control circuit. Each of the drive signals can assume either of a positive voltage VM, a negative voltage −VM, and a zero voltage 0(V).

Each of the scanning drives YD1–YDm and the data drives XD1–XDn is composed of a known driver circuit using FET's. The voltage values VH and VM and a threshold value (a photoemission starting voltage) Vt of the EL photoemissive layer 2003 have the following relations.

$$0<VM<VH<Vt,\ VH+VM>Vt$$

Thus, when the scanning driver YDi ($1 \leqq i \leqq m$) and the data driver XDj ($1 \leqq j \leqq n$) cooperate to apply a drive voltage of a level of VH+VM between the scanning electrode Yi and the data electrode Xj, a portion of the EL photoemissive layer 2003 which corresponds to a pixel Zij can emit light.

Figure 30:
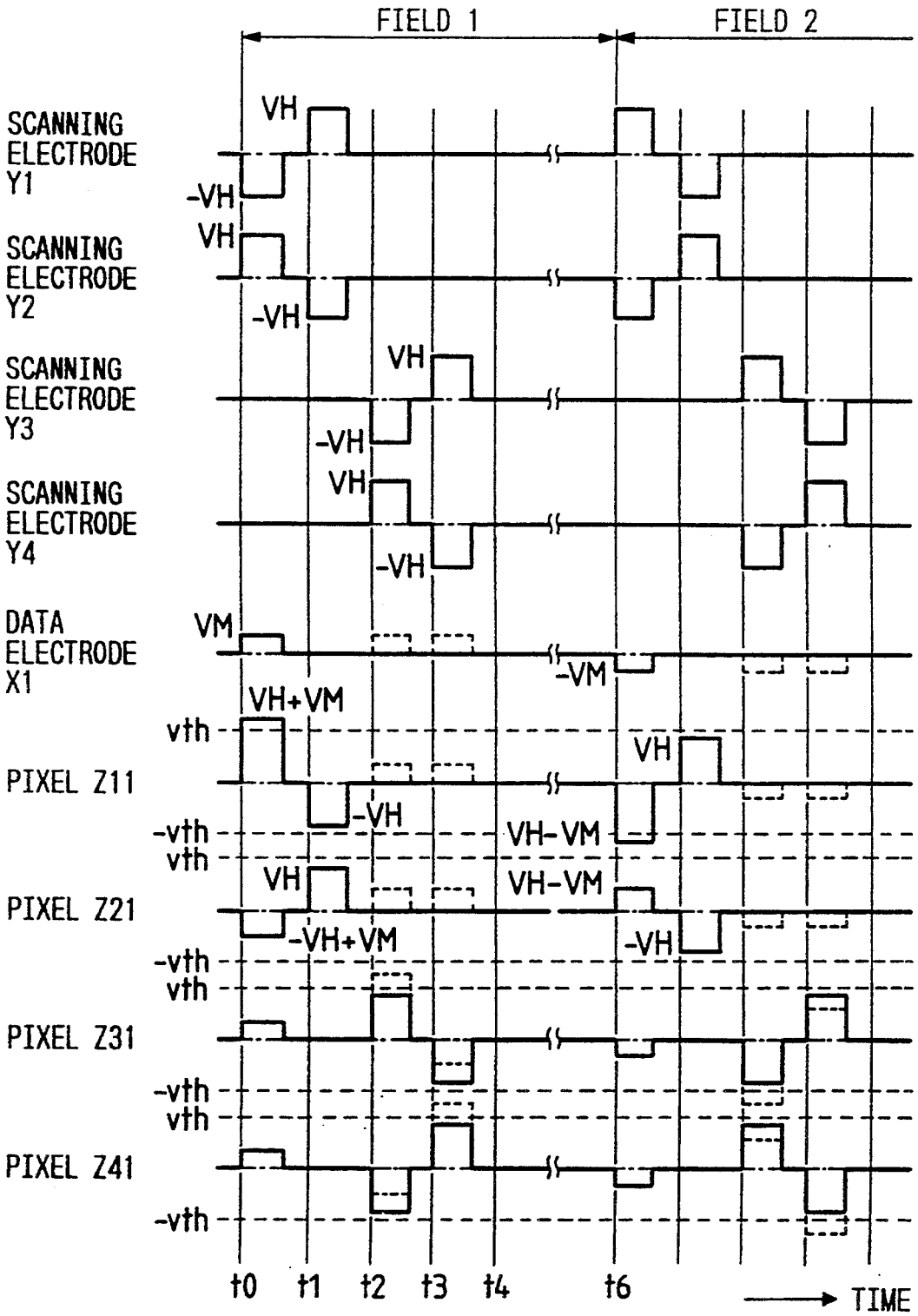
FIG. 30 is a timing diagram showing the waveforms of voltages applied to scanning electrodes, data electrodes, and pixels in the EL display of FIG. 29.

Operation of the EL display 2001 will now be described with reference to FIG. 30. In FIG. 30, the solid lines show conditions where only a pixel Z11 is excited to emit light. During a period between moments t0 and t1, a pulse voltage −VH is applied to the scanning electrode Y1 and a pulse voltage VH is applied to the scanning electrode Y2. At the same time, a pulse voltage VM is applied to the data electrode X1. No voltage is applied to the other electrodes Y3–Ym and X2–Xn. Here, a voltage applied to a pixel Zij is defined as being equal to a voltage at a data electrode Xj relative to a voltage at a scanning electrode Yi.

In the above-mentioned case, a voltage VH+VM (higher than Vt) is applied to the pixel Z11 so that a portion of the EL photoemissive layer 2003 which corresponds to the pixel Z11 emits light. A voltage −VH+VM is applied to the second-row first-column pixel Z21, and a voltage VM is applied to the first-column pixels Zh1 (3≦h≦m) in other rows. In addition, although illustration is omitted from FIG. 30, a voltage VH is applied to the first-row pixels Z1*k* (2≦k≦n) in the second and later columns while a voltage −VH is applied to the second-row pixels Z2*k* (2≦k≦n) in the second and later columns. The voltage −VH+VM, the voltage VM, the voltage VH, and the voltage −VH are smaller than the threshold voltage Vt so that portions of the EL photoemissive layer 2003 which correspond to the pixels Z21, Zh1, Z1*k*, and Z2*k* do not emit light. Furthermore, no voltage is applied to other pixels Zhk (3≦h≦m, 2≦k≦n). Thus, only the pixel Z11 emits light.

In the above-mentioned case, all the pixels Z1j in the first row are subjected to the positive voltages while all the pixels Z2j in the second row are subjected to the negative voltages. The EL photoemissive layer 2003 vibrates by the application of the voltages. A polarity of vibrations of portions of the EL photoemissive layer 2003 which correspond to the pixels Z1j is opposite to a polarity of vibrations of portions of the EL photoemissive layer 2003 which correspond to the pixels Z2j. Thus, in the EL display 2001, the vibrations cancel each other, and noise is effectively suppressed. The pulse voltage −VH, the pulse voltage VH, and the pulse voltage VM correspond to a scanning voltage, an antiphase voltage which is opposite in polarity, and a data voltage respectively.

During a subsequent period between the moment t1 and a moment t2, a pulse voltage VH is applied to the scanning electrode Y1 and a pulse voltage −VH is applied to the scanning electrode Y2. During a period between the moment t2 and a moment t3, a pulse voltage −VH is applied to the scanning electrode Y3 and a pulse voltage VH is applied to the scanning electrode Y4. During a period between the moment t3 and a moment t4, a pulse voltage VH is applied to the scanning electrode Y3 and a pulse voltage −VH is applied to the scanning electrode Y4. During a later period until a moment t6, a pulse voltage VH and a pulse voltage −VH are applied to the scanning electrodes Y1–Ym in such a manner that polarities of pulse drive signals applied to adjacent scanning electrodes Yl and Yl −1 (l denotes an even number) are opposite.

In the case where at least one of pixels Zil–Zin in a row subjected to a pulse voltage −VH is required to emit light, a pulse voltage VM is applied to a data electrode Xj corresponding to a column containing the required pixel. In FIG. 3, the broken lines show conditions where pixels Z31 and Z41 are excited to emit light in addition to the pixel Z11. During the period between the moments t2 and t3, a pulse voltage VM is applied to the data electrode X1 in synchronism with the application of a pulse voltage −VH to the scanning electrode Y3 so that the pixel Z31 is subjected to a voltage VH+VM. Similarly, during the period between the moments t3 and t4, a pulse voltage VM is applied to the data electrode X1 in synchronism with the application of a pulse voltage −VH to the scanning electrode Y4 so that the pixel Z41 is subjected to a voltage VH+VM. Thus, portions of the EL photoemissive layer 2003 which correspond to the pixels Z31 and Z41 emit light.

The period between the moments t0 and t6 is referred to as a field 1. During a field 2 which starts from the moment t6, the electrodes X1–Xn and Y1–Ym are subjected to voltages of polarities opposite to polarities of the voltages applied during the field 1. Thus, during the field 2, a pixel Zij which emits light during the field 1 is excited again to emit light, and charges stored in the EL photoemissive layer 3 during the field 1 can be removed or swept. In the display 2001, the processes in the field 1 and the processes in the field 2 are reiterated, so that a two-dimensional image can be indicated.

In the EL display 2001, scanning electrodes Yl and Yl−1 subjected to drive voltages of opposite polarities are adjacent, and scanning drivers YDl and YDl−1 for the scanning electrodes Yl and Yl−1 are located on the same side of the EL photoemissive layer 2003. This design enables effective cancellation of vibrations of the EL photoemissive layer 3 at locations corresponding to the scanning electrodes Yl and Yl−1.

The method of drive of the EL display 2001 may be replaced by a field refleshment method in which refleshment pulses of polarities opposite to polarities of drive signals are applied to remove charges from the EL photoemissive layer 2003 each time a field terminates.

It should be noted that scanning electrodes subjected to drive voltages of opposite polarities may not be adjacent. For example, a first-row scanning electrode and a third-row scanning electrode may be subjected to drive voltages of opposite polarities. In addition, it should be noted that scanning drivers YDl and YDl−1 for the scanning electrodes Yl and Yl−1 may not be located on the same side of the EL photoemissive layer 2003.

The absolute value of the pulse voltage −VH and the absolute value of the pulse voltage VH may be different. In FIG. 2, during the period between the moments t0 and t1, the sum of the voltages applied to the pixels Zij (1≦i≦m, 1≦j≦n) is offset from 0 volt in the positive direction by a value corresponding to the pulse voltage VM. Thus, during the period between the moments t0 and t1, noise can be more effectively suppressed by slightly increasing the height of the pulse voltage −VH. Furthermore, the rate of increasing the height of the pulse voltage −VH may be adjusted in accordance with the number of data electrodes Xj subjected to the pulse voltage VM.

It should be noted that the voltage value VH may be smaller than the voltage value VM. In this case, a phase of vibrations of portions of the EL photoemissive layer 2003 which correspond to pixels Z1*k* (2≦ik≦n) in the second and later columns is opposite to a phase of vibrations of portions of the EL photoemissive layer 2003 which correspond to pixels Z2k, so that noise can be suppressed.

In FIG. 30, during the period between the moments t0 and t1, a pulse voltage −VM may be applied to the data electrode X2. In this case, a voltage applied to the second-row second-column pixel Z22 is equal to a level −VH−VM, and thus the pixel Z22 emits light. In addition, vibration of the EL photoemissive layer 2003 which is caused by the application of the pulse voltage −VM to the data electrode X2 cancel vibration of the EL photoemissive layer 2003 which is caused by the application of the pulse voltage VM to the data electrode X1. Thus, noise can be more effectively suppressed.

A nineteenth embodiment of this invention is similar to the embodiment of FIGS. 29 and 30 except for design changes indicated later.

Figure 31:
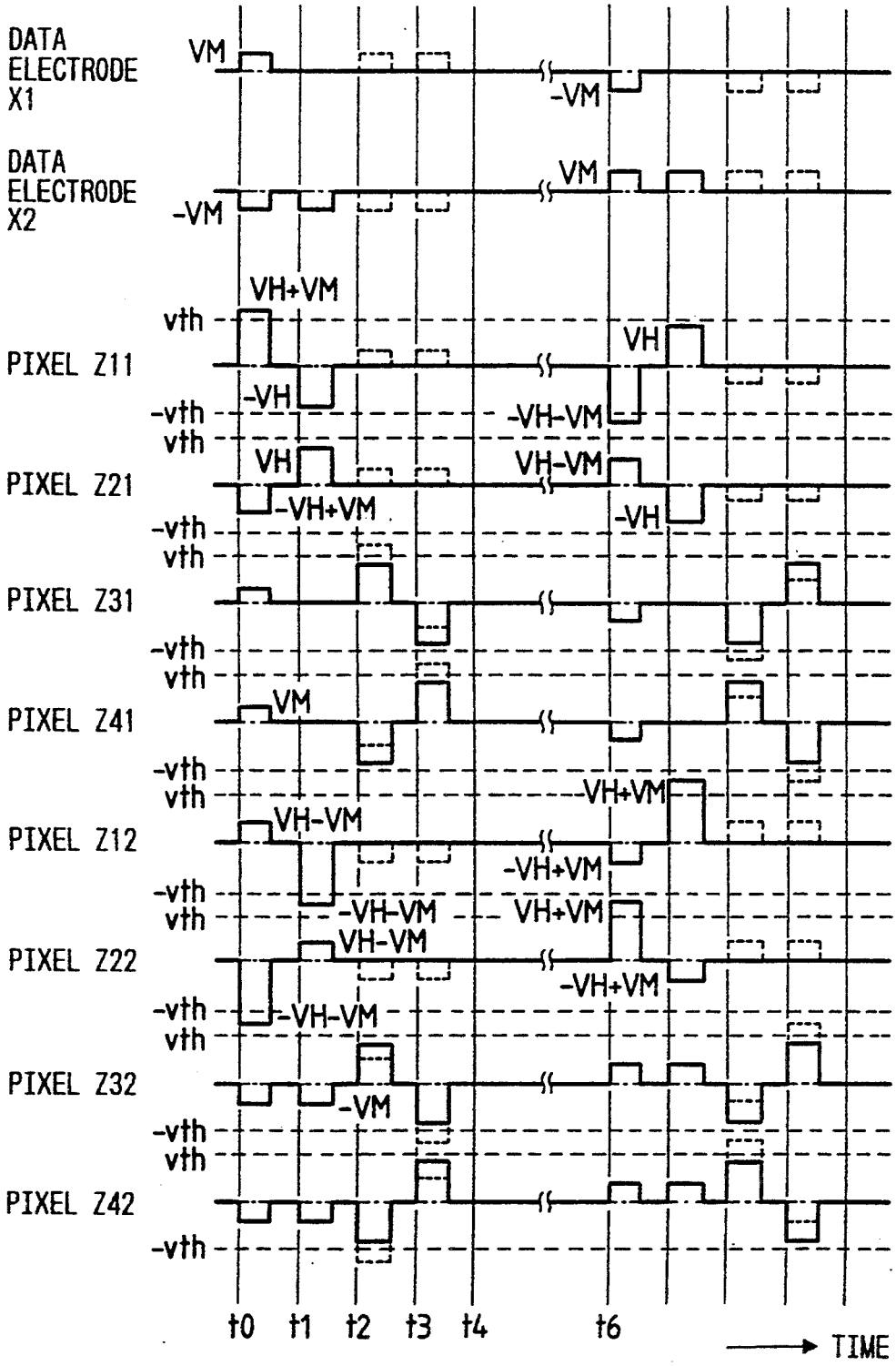
FIG. 31 is a timing diagram showing the waveforms of voltages applied to data electrodes and pixels in an EL display according to a nineteenth embodiment of this invention.

FIG. 31 shows an example of operating conditions of an EL display according to the nineteenth embodiment of this invention. In FIG. 31, the solid lines show conditions where pixels Z11, Z12, and Z22 are excited to emit light. Drive voltages applied to scanning electrodes Y1–Y4 vary as in the embodiment of FIGS. 29 and 30, and description and illustration of these drive voltages will be omitted.

As shown in FIG. 31, during a period between moments t0 and t1, a pulse voltage VM is applied to a data electrode X1 but no voltage is applied to data electrodes X3–Xn, and the following voltage is applied to a data electrode X2. Specifically, during the period between the moments t0 and t1, a pulse voltage −VM is applied to the data electrode X2 once. Also, during a period between the moment t1 and t2, a pulse voltage −VM is applied to the data electrode X2 once.

Thus, voltages applied to second-row pixels Zi2 ($1 \leqq i \leqq m$) vary as follows. During the period between the moments t0 and t1, scanning electrodes Y1 and Y2 are subjected to a pulse voltage −VH and a pulse voltage VH respectively, and scanning electrodes Y3–Ym are subjected to a zero voltage (see FIG. 30). Thus, as shown in FIG. 31, a first-row second-column pixel Z12 is subjected to a pulse voltage VH−VM and a second-row second-column pixel Z22 is subjected to a pulse voltage −VH−VM, and third-row and later-row pixels Zh2 ($3 \leqq h \leqq m$) in the second column are subjected to a pulse voltage −VM. Since the absolute value of the pulse voltage −VH−VM is greater than the threshold value Vt, the Z22 emits light. On the other hand, since the pulse voltage VH−VM and the absolute value of the pulse voltage −VM is smaller than the threshold value Vt, the pixels Z12 and Z32−Zm2 do not emit light.

During the period between the moments t0 and t1, as shown in FIG. 31, third-row and later-row pixels Zh1 ($3 \leqq h \leqq m$) in the first column are subjected to a pulse voltage VM. Thus, vibrations of portions of the EL photoemissive layer 2003 which correspond to the pixels Zh1 cancel vibrations of portions of the EL photoemissive layer 2003 which correspond to the pixels Zh2. Accordingly, in the EL display, noise is more effectively suppressed.

During a subsequent period between the moment t1 and a moment t2, no voltage is applied to the data electrode X1 but a pulse voltage −VM is applied to the data electrode X2. Thus, the first-row second-column pixel Z12 is subjected to a pulse voltage −VH−VM and the second-row second-column pixel Z22 is subjected to a pulse voltage VH−VM, and the third-row and later-row pixels Zh2 ($3 \leqq h \leqq m$) in the second column are subjected to a pulse voltage −VM. As a result, only the pixel Z22 emits light. Furthermore, as shown by the broken lines of FIG. 31, in the case where a pulse voltage −VM is applied to the data electrode X2 during a period between moments t2 and t3 and during a period between moments t3 and t4, the pixels Z32 and Z42 emit light.

Figure 32:
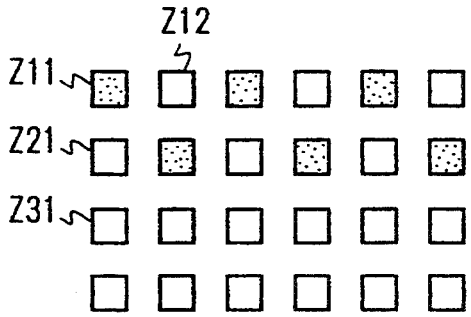
FIGS. 32*a*–32*d*, FIGS. 33*a*–33*d* and FIGS. 34*a*–34*d* are diagrams showing photoemission control patterns in the nineteenth embodiment of this invention.
Figure 32:
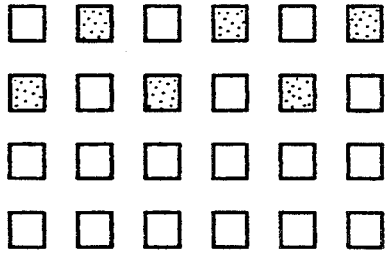
Figure 32:
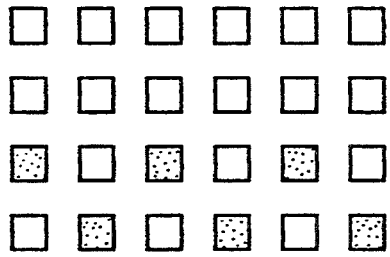
Figure 32:
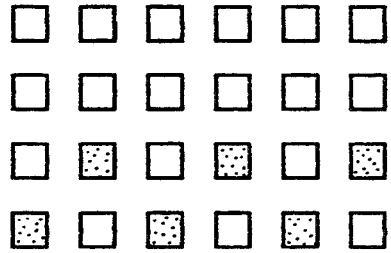
Figure 33A:
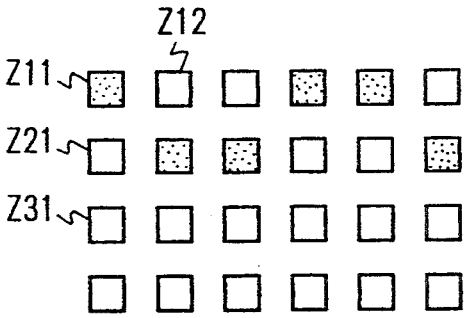
Figure 33B:
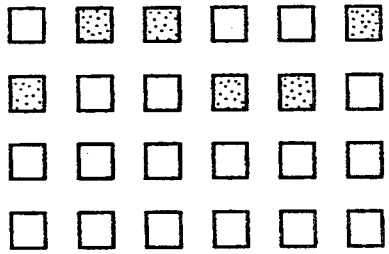
Figure 33C:
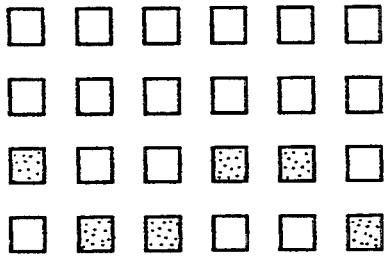
Figure 33D:
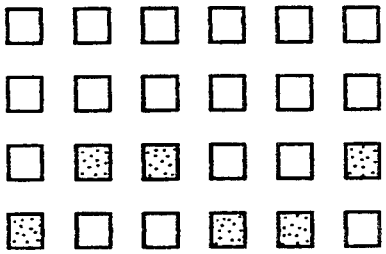
Figure 34:
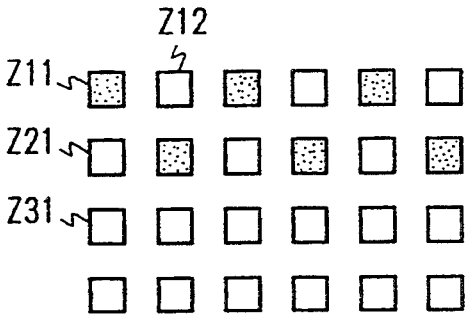
Figure 34:
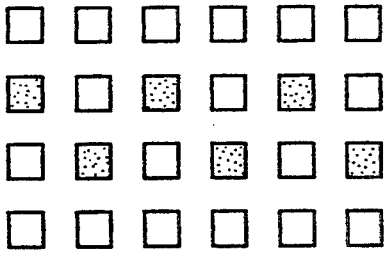
Figure 34:
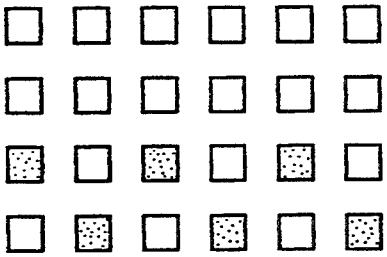
Figure 34:
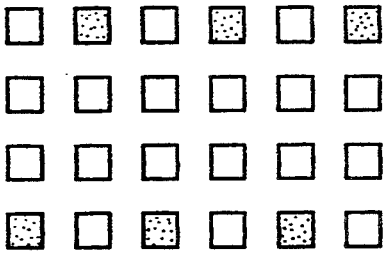

Control of photoemission is executed in one of various patterns which will be described later. FIGS. 32–34 show some members of pixels Zij.

In the case where columns subjected to a pulse voltage VM during a field 1 and columns subjected to a pulse voltage −VM during the field 1 are exchanged every other column, a photoemission control pattern shown in FIG. 32 can be realized. In this case, during a first stage, first-row pixels in odd columns and second-row pixels in even columns are controlled to emit light as shown in the part (a) of FIG. 32. During a second stage, first-row pixels in even columns and second-row pixels in odd columns are controlled to emit light as shown in the part (b) of FIG. 32. During a third stage, third-row pixels in odd columns and fourth-row pixels in even columns are controlled to emit light as shown in the part (c) of FIG. 32. During a fourth stage, third-row pixels in even columns and fourth-row pixels in odd columns are controlled to emit light as shown in the part (d) of FIG. 32.

In the case where columns subjected to a pulse voltage VM during a field 1 and columns subjected to a pulse voltage −VM during the field 1 are exchanged every third column, a photoemission control pattern shown in FIG. 33 can be realized. In this case, during a first stage, first-row pixels in first, fourth, and fifth columns and second-row pixels in second, third, and sixth columns are controlled to emit light as shown in the part (a) of FIG. 33. During a second stage, first-row pixels in second, third, and sixth columns and second-row pixels in first, fourth, and fifth columns are controlled to emit light as shown in the part (b) of FIG. 33. During a third stage, third-row pixels in first, fourth, and fifth columns and fourth-row pixels in second, third, and sixth columns are controlled to emit light as shown in the part (c) of FIG. 33. During a fourth stage, third-row pixels in second, third, and sixth columns and fourth-row pixels in first, fourth, and fifth columns are controlled to emit light as shown in the part (d) of FIG. 33.

In the case where a combination of scanning electrodes Yi subjected to drive pulse signals of opposite phases is sequentially changed as a combination of scanning electrodes Y1 and Y2, a combination of scanning electrodes Y2 and Y3, . . . , and where columns subjected to a pulse voltage VM and columns subjected to a pulse voltage −VM are exchanged every other column, a photoemission control pattern shown in FIG. 34 can be realized. In this case, during a first stage, first-row pixels in odd columns and second-row pixels in even columns are controlled to emit light as shown in the part (a) of FIG. 34. During a second stage, second-row pixels in odd columns and third-row pixels in even columns are controlled to emit light as shown in the part (b) of FIG. 34. During a third stage, third-row pixels in odd columns and fourth-row pixels in even columns are controlled to emit light as shown in the part (c) of FIG. 34. During a fourth stage, fourth-row pixels in odd columns and first-row pixels in even columns are controlled to emit light as shown in the part (d) of FIG. 34.

A twentieth embodiment of this invention is a modification of the embodiments of FIGS. 29–34. In the twentieth embodiment, insulating layers or other suitable layers are provided between an array of scanning electrodes Y1-Ym and an EL photoemissive layer 2003 (see FIG. 29), and between an array of data electrodes X1-Xn and the EL photoemissive layer.

What is claimed is:

1. An EL display comprising:

a first EL element and a second EL element, wherein each EL element includes:

a pair of electrodes; and an EL photoemissive layer disposed between the electrodes, wherein the EL photoemissive layer is capable of emitting light when a voltage applied between the electrodes is equal to or greater than a threshold value; and voltage feed means for applying a first ac voltage between the electrodes of the first EL element, and for applying a second ac voltage between the electrodes of the second EL element at the same time as the application of the first ac voltage, wherein the first ac voltage has a value which is equal to or greater than the threshold value, wherein the second ac voltage has a polarity which is opposite to a polarity of the first ac voltage so that the application of the second ac voltage at the same time as the application of the first ac voltage enhances a noise suppression effect, wherein the second ac voltage has a value which is equal to or greater than the threshold value when photoemission of the second EL element is required, and wherein the second ac voltage has a value which is smaller than the threshold value when photoemission of the second EL element is not required.

2. The EL display of claim 1, wherein the first EL element and the second EL elements are arranged in a laminated structure.

3. The EL display of claim 2, wherein one of the electrodes of the first EL element and one of the electrodes of the second EL element are comprised of a common electrode.

4. The EL display of claim 1, wherein the first EL element and the second EL element are disposed adjacent to each other in a common plane.

5. The EL display of claim 4, wherein one of the electrodes of the first EL element and one of the electrodes of the second EL element are comprised of a common electrode.

6. The EL display of claim 4, wherein one of the electrodes of the first EL element and one of the electrodes of the second EL element are comprised of a common electrode, and the EL photoemissive layer of the first EL element and the EL photoemissive layer of the second EL element are comprised of a common EL photoemissive layer.

7. The EL display of claim 5, wherein the common electrode is in an open state, and one of the first ac and voltage second ac voltage has a value equal to or greater than twice the threshold value.

8. The EL display of claim 6, wherein the common electrode is in an open state, and one of the first ac voltage and the second ac voltage has a value equal to or greater than twice the threshold value.

9. The EL display of claim 4, further comprising at least a third EL element, and wherein the first EL element, the second EL element and the at least a third EL element are arranged in a matrix, and wherein the voltage feed means comprises means for scanning the matrix while applying ac voltages thereto.

10. The EL display of claim 1, further comprising:

a first insulating layer disposed between one of the electrodes and the EL photoemissive layer in the first EL element and the second EL element; and a second insulating layer disposed between the other electrode and the EL photoemissive layer in the first EL element and the second EL element.

11. The EL display of claim 1, wherein the first ac voltage and the second ac voltage each have rectangular waveforms.

12. The EL display of claim 1, further comprising:

an even number of additional EL elements, and wherein the voltage feed means comprises means for applying first-type ac voltages between the electrodes of half of the additional EL elements, and for applying second-type ac voltages between the electrodes of the other half of the additional EL elements, wherein the first-type ac voltages have a polarity opposite to a polarity of the second-type ac voltages.

13. An EL display comprising:

a plurality of EL elements, each disposed so as to be capable of indicating either of preset characters, wherein each of the EL elements is capable of emitting light when a voltage having an absolute value which is equal to or greater than a threshold value is applied thereto, and wherein the EL elements include at least a first EL element and a second EL element;

means for feeding a first ac drive voltage to the first EL element so as to activate the first EL element, wherein the first ac drive voltage have a value which is equal to or greater than the threshold value; and means for feeding a second ac drive voltage to the second EL element, at the same time the first ac drive voltage is fed to the first EL element, so as to activate the second EL element at the same time the first EL element is activated, wherein the second ac drive voltage have a value which is equal to or greater than the threshold value, and wherein the second ac drive voltage have a polarity which is opposite to a polarity of the first ac drive voltage.

14. The EL display of claim 13, wherein the EL elements further includes at least a third EL element, and wherein the EL display further comprises:

means for feeding a third ac voltage to the third EL element, at the same time first ac drive voltage is fed to the first EL element and at the same time the second ac drive voltage is fed to the second EL element, so as to enhance a noise suppression effect, wherein the third ac voltage have a value which is smaller than the threshold value, wherein the third ac voltage have a polarity which is opposite to one of the polarities of the first ac drive voltage and the second ac drive voltage, and wherein the third EL element is disposed adjacent to one of the first EL element and the second EL element.

15. An EL display comprising:

an EL photoemissive layer which is capable of emitting light when a voltage having an absolute value equal to or greater than a threshold value is applied thereto, wherein the EL photoemissive layer has a first surface and a second surface;

a plurality of scanning electrodes disposed on the first surface, wherein the scanning electrodes are disposed so as to be parallel to each other;

a plurality of data electrodes disposed on the second surface, wherein the data electrodes are disposed so as to be parallel to each other;

scanning-electrode voltage feed means for sequentially feeding a scanning voltage to the scanning electrodes and for sequentially feeding an anti-phase voltage to the scanning electrodes, wherein the scanning voltage has an absolute value which is smaller than the threshold value, wherein the anti-phase voltage has an absolute value smaller than the threshold value, wherein the scanning voltage and the anti-phase voltage are fed, at the same time, to different scanning electrodes and wherein the anti-phase voltage has a polarity which is opposite to a polarity of the scanning voltage; and data-electrode voltage feed means for feeding, at the same time the scanning voltage is fed to the scanning electrodes, a data voltage to a selected one of the data electrodes, wherein the data voltage has an absolute value which is smaller than the threshold value, wherein the absolute value of the data voltage is greater than the threshold value minus the scanning voltage, and wherein the data voltage has a polarity which is opposite to the polarity of the scanning voltage; and wherein the scanning-electrode voltage feed means feeds the scanning voltage and the anti-phase voltage to adjacent pairs of the scanning electrodes so as to enhance a noise suppression effect.

16. An EL display comprising:

a first EL photoemissive layer having an axis related to piezoelectricity;

a second EL photoemissive layer having an axis related to piezoelectricity,. wherein the first EL photoemissive layer and the second EL photoemissive layer are disposed so as to be adjacent to each other;

first means for generating an ac voltage;

second means for applying a first ac electric field to the first EL photoemissive layer so as to activate the first EL photoemissive layer in response to the ac voltage generated by the first means; and third means for applying a second ac electric field to the second EL photoemissive layer so as to activate the second EL photoemissive layer in response to the ac voltage generated by the first means, wherein the third means applies the second ac electric field simultaneously with the application of the first ac electric field by the second means, and wherein a direction of the first ac electric field relative to the piezoelectricity-related axis of the first EL photoemissive layer is substantially antiparallel to a direction of the second ac electric field relative to the piezoelectricity-related axis of the second EL photoemissive layer.

17. An EL display comprising:

a first EL photoemissive layer having an axis related to piezoelectricity;

a second EL photoemissive layer having an axis related to piezoelectricity, wherein the first EL photoemissive layer and the second EL photoemissive layer are disposed so as to be adjacent to each other;

first means for generating a first ac voltage having a first polarity;

second means for applying a first ac electric field to the first EL photoemissive layer so as to activate the first EL photoemissive layer in response to the first ac voltage generated by the first means;

third means for generating a second ac voltage having a second polarity, wherein the second polarity is equal to the first polarity; and fourth means for applying a second ac electric field to the second EL photoemissive layer so as to activate the second EL photoemissive layer in response to the second ac voltage generated by the third means, wherein the fourth means applies the second ac electric field simultaneously with the application of the first ac electric field by the second means, and wherein a direction of the first ac electric field relative to the piezoelectricity-related axis of the first EL photoemissive layer is substantially antiparallel to a direction of the second ac electric field relative to the piezoelectricity-related axis of the second EL photoemissive layer.

18. The EL display of claim 17, wherein the first ac voltage and the second ac voltage each comprise a common ac voltage.

* * * * *